US011980287B1

(12) United States Patent
Appolloni

(10) Patent No.: US 11,980,287 B1
(45) Date of Patent: May 14, 2024

(54) BACKWARD-ANGLED DUAL-FRAME CABINET SYSTEM

(71) Applicant: Steve Appolloni, Albuquerque, NM (US)

(72) Inventor: Steve Appolloni, Albuquerque, NM (US)

( * ) Notice: Subject to any disclaimer, the term of this patent is extended or adjusted under 35 U.S.C. 154(b) by 0 days.

(21) Appl. No.: 18/528,421

(22) Filed: Dec. 4, 2023

(51) Int. Cl.
*A47B 77/02* (2006.01)

(52) U.S. Cl.
CPC ..... *A47B 77/02* (2013.01)

(58) Field of Classification Search
CPC ..... A47B 77/02
USPC ..... 312/198, 107, 108, 199; 108/48
See application file for complete search history.

(56) References Cited

U.S. PATENT DOCUMENTS 2,404,182 A * 7/1946 Kump, Jr. ..... A47B 87/008 312/107
2,636,224 A * 4/1953 Murdoch ..... E04B 2/7425 312/304
2,710,241 A * 6/1955 Lieberman ..... A47B 47/05 312/351
2,849,270 A 8/1958 Warnock
2,965,428 A * 12/1960 Jacobs ..... A47B 57/565 312/107
4,034,682 A * 7/1977 Bizinover ..... A47B 47/05 211/187
4,066,305 A * 1/1978 Gazarek ..... A47B 17/00 312/265.6
4,461,519 A * 7/1984 Hildebrandt ..... A47B 47/03 52/801.1
5,513,908 A * 5/1996 Williams ..... A47B 77/02 211/90.03

(Continued)

FOREIGN PATENT DOCUMENTS

DE 9101567 U1 5/1991
DE 29819026 U1 1/1999

(Continued)

OTHER PUBLICATIONS https://www.architonic.com/en/product/wintons-teak-planar-sofa/1314521 Nov. 1, 2023.

(Continued)

*Primary Examiner* — Daniel J Troy
*Assistant Examiner* — Timothy M Ayres
(74) *Attorney, Agent, or Firm* — Robert D. Watson

(57) ABSTRACT

A backward-angled, dual-frame, open cabinet system that is minimalist in design. The open, dual-frame system eliminates hiding spots for common pests, such as mice and roaches. The cabinet does not have a back leg that extends down to the floor, and the cabinet is hung from a wall, or placed back-to-back with another cabinet. Adjacent cabinets can share a common subframe. The metallic design withstands high humidity and common abuse associated with heavily-used spaces. It is easy to clean, and it minimizes common repair costs. The cabinets have faces that can be replaced as needed, or refaced completely, at a lessor cost. The storage area is further maximized by eliminating the common horizontal (stretchers) found in most wood type cabinets. The backward-angled face panels offer enhanced spill resistance. The typical toe recess is replaced by using backward-angled front legs and panels, effectively safe guarding one's foot against contact.

20 Claims, 26 Drawing Sheets

(56) References Cited

U.S. PATENT DOCUMENTS

| | | | | | |
|---|---|---|---|---|---|
| 5,921,647 | A * | 7/1999 | Schneider | A47B 47/05 | 211/187 |
| D424,325 | S * | 5/2000 | Iannaccone | D6/655 | |
| 6,314,892 | B1 * | 11/2001 | Favini | A47B 3/0803 | 108/115 |
| 6,997,115 | B2 * | 2/2006 | Lockwood | A47B 3/0803 | 108/115 |
| 7,451,535 | B2 | 11/2008 | Wells | | |
| 7,975,626 | B1 * | 7/2011 | Wang | A47B 3/002 | 108/50.01 |
| 9,332,834 | B2 * | 5/2016 | Merey | A47B 3/0818 | |
| 9,381,605 | B2 * | 7/2016 | Moyer | B23Q 3/18 | |
| 9,433,286 | B2 | 9/2016 | Kane | | |
| 2005/0263039 | A1 * | 12/2005 | Frampton | A47B 5/06 | 108/42 |

FOREIGN PATENT DOCUMENTS

| | | | |
|---|---|---|---|
| DE | 29819026 | | 10/2008 |
| EP | 0482416 | A1 | 4/1992 |
| FR | 1242195 | A | 9/1960 |
| GB | 585269 | A | 2/1947 |
| WO | WO2021232964_EN | | 11/2021 |

OTHER PUBLICATIONS https://detroit.curbed.com/2019/6/26/18760666/pedini-showroom-opens-downtown-detroit. Jun. 26, 2019.

* cited by examiner

SEC. A-A

BACKWARD-ANGLED DUAL-FRAME CABINET SYSTEM

TECHNICAL FIELD

The present disclosure relates to a backward-angled, dual-frame cabinet system for use in household kitchens, commercial kitchens, and industrial applications.

INTRODUCTION

Traditional cabinets for use in household kitchens, commercial kitchens, and industrial applications are closed boxes that are either hung from a wall or sit on a floor, with a traditional 4½" toe kick height and 3" deep recess. These closed boxes, and more notably, the toe kick areas offer places for mice, rats, and roaches to hide. Additionally, a traditional cabinet is usually made of plywood or particleboard, which is susceptible to damage from water or moisture (including flooding). The use of closed boxes do not allow wet dishes and cups to dry quickly, possibly causing bacterial growth in humid environments. Also, there is no room underneath to store a robotic vacuum cleaner unit or traditional mop. The closed construction of traditional cabinets do not allow visual access to the inside of the cabinet (unless the front doors are opened). The toe kick areas and wall attachments areas are commonly out-of-plumb and level providing crevices for pests to hide. Compliance with the America Disabilities Act (ADA) and the FDA, OSHA have hygiene requirements are very mandated in commercial and industrial designs. High volume use areas are generally cleaned using mop bucks where a large volume of water is used. It is common for straight, four-leg table or counters to be installed. The traditional back legs are also the most difficult to clean around and allow pests to hide.

Against this background, the present invention was developed.

SUMMARY

In some embodiments, a backward-angled, dual-frame cabinet system can have a pair of tubular subframes attached to a pair of wire mesh shelves, with large openings on one or more sides for easy cleaning, with no places for pests to hide. The system also allows air flow needed for dying cooking elements and associated plates and glasses, thereby preventing bacterial growth. The system meets the design needs for longevity by using tubular channels (which can be made of metal) that feature replaceable face panels, are easy to clean, have minimal parts, and are lighter in weight and stronger than typical wood or particleboard cabinets. There are generally no backs or sides, which allow visual and physical access throughout the cabinet system. The system is based on three points of contact (two front legs and a backside post that attaches directly to a wall or another cabinet). Hence, the system has no back legs that extend down to the floor.

In some embodiments, a backward-angled, dual-frame cabinet system can include hollow or solid metal frames that provide strength without the need for using a common horizontal stretcher between every door or drawer. This adds vertical functional space to each cabinet design. Backward-angled front doors eliminate the need for a traditional toe kick, thereby adding at least four inches in height to the typical cabinet space. Backward-angled front legs improve functional use, reduces spills onto the front panels (e.g., doors, false fronts), and eliminates the common toe kick.

Using a backward-angled, dual-frame system provides the largest storage capacity in base cabinets that are commercially available today.

The backward-angled front legs eliminate the need for toe protection, while also offering a spill resistance feature. The backward-angled front legs can be recessed about three inches at the bottom, thereby providing additional clearance for ADA wheel chair travel, while reducing the possible damage to the cabinets under normal wheelchair use. The front panels can be recessed about ½" from the front edge of the front legs and are oriented parallel to the backward-angled front legs, which provides additional physical protection of the front panels from wheelchair use. The bottom shelf can be located about 6" above the floor, which allows for a robotic vacuum cleaner unit to be stored underneath and easy access for a traditional mop underneath the cabinet.

In some embodiments, a main front cabinet has two front legs (which can be backward-angled or straight (i.e., vertical)). The backside of the cabinet can be hung from an existing wall structure, available in most applications. A straight (vertical) leg is generally used where a cabinet abuts against an appliance, e.g., a dishwasher or oven/range unit. In some embodiments, a single cabinet can have one backward-angled front leg and a straight (vertical) front leg. Where additional cabinets are located adjacent to the first cabinet (i.e., side-by-side), only one front leg is needed to support each additional cabinet (not two front legs). In other words, two adjacent cabinets share a common front leg. When a wall is not present, then two cabinets can be installed back-to-back, or a back leg can be added as needed. Where applicable (e.g., commercial or industrial settings), a metal cabinet frame system can be hosed, mopped, or washed with water.

In another embodiment, a cabinet subframe can include a set of four, linear segments joined together to make a four-sided, planar, cabinet subframe with a central opening; wherein the cabinet subframe comprises a front leg that extends downwards to the floor; and the cabinet subframe does not have a back leg that extends down to the floor.

In another embodiment, a dual-frame cabinet can include:

- a first cabinet subframe, comprising a first set of four linear segments that are joined together to make a first, planar, four-sided cabinet subframe with a first central opening;
- a second cabinet subframe, comprising a second set of four linear segments that are joined together to make a second, planar, four-sided cabinet subframe with a second central opening;
- a top horizontal support frame that is attached to an upper part of both the first cabinet subframe and the second cabinet subframe; and
- a bottom horizontal support frame that is attached to a lower part of both the first cabinet subframe and the second cabinet subframe;
- wherein the first cabinet subframe comprises a first, backward-angled, front leg that extends downwards to a floor;
- wherein the first cabinet subframe does not have a first back leg that extends down to the floor;
- wherein the second cabinet subframe comprises a second, backward-angled, front leg that extends downwards to the floor; and
- wherein the second cabinet subframe does not have a second back leg that extends down to the floor.

In another embodiment, a cabinet system comprises a first dual-frame cabinet attached to a second dual-frame cabinet; wherein the first dual-frame cabinet comprises a first cabinet subframe attached to a second cabinet subframe; wherein the second dual-frame cabinet comprises the second cabinet subframe attached to a third cabinet subframe; and wherein the first dual-frame cabinet and the second dual-frame cabinet share the second cabinet subframe.

DETAILED DESCRIPTION OF THE DISCLOSURE

The word "tubing" broadly includes structural channels (metallic, wood, or polymeric) that can have a rectangular, square, triangular, hexagonal, oval, or round cross-section, and which can be solid or hollow in cross-section. The word "about" means+/−10% of the stated value. The phrase "backward-angled front leg" includes a backward angle, θ, equal to 0 degrees (i.e., a straight, vertically-oriented front leg).

Figure 1:
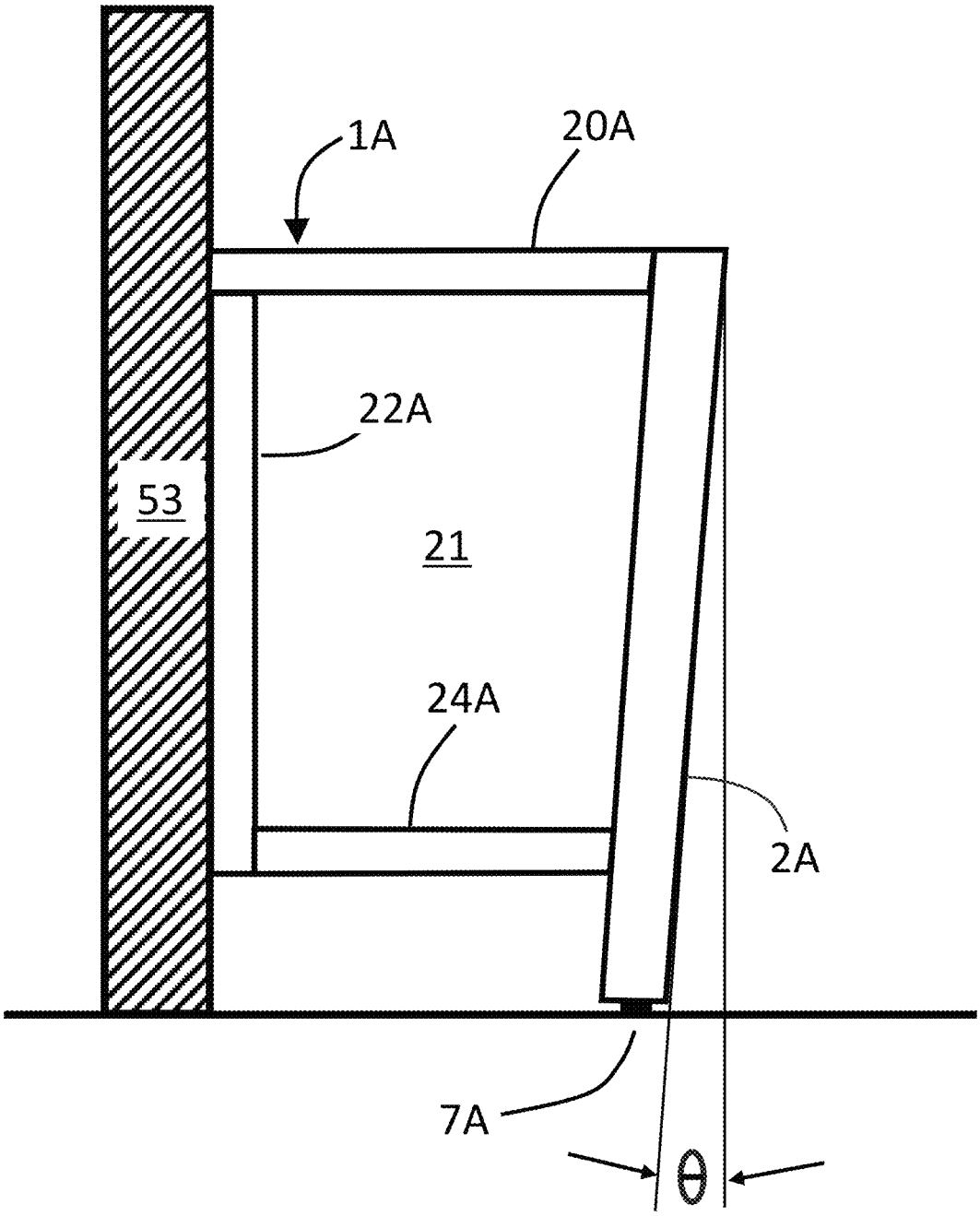
FIG. 1 shows a schematic, side view of an example of an open, planar subframe for a cabinet, with a backward-angled pair of front legs. according to the present disclosure.

FIG. 1 shows a schematic, side view of an example of an open, planar subframe 1A for a cabinet 30, with a backward-angled front leg 2A, according to the present disclosure. Front leg 2A is angled backwards at a backward angle=θ (relative to a vertical plumb line), where θ can range from 0-10 degrees. A preferred angle, θ=4 degrees. Subframe 1A can comprise a set of four, linear segments that are rigidly attached together to make a four-sided, open structure, including: vertical back post 22A, angled front leg 2A, horizontal bottom brace 24A, and horizontal top brace 20A. The set of four, linear segments 22A, 2A, 24A, and 20A can be welded, soldered, brazed, riveted, or mechanically attached together to make subframe 1A. Vertical back post 22A can be attached to wall 53 with screws (not shown) or other attachment means. Central opening 21 is disposed inside of subframe 1A.

Referring still to FIG. 1, each linear segment 22A, 2A, 24A, and 20A can comprise a hollow channel (i.e., a hollow, rectangular "tube") or a solid bar, or combinations thereof. The material used for subframe 1A can be, for example, wood, polymer, fiber-reinforced polymer, or a structural metal chosen from: iron, steel, aluminum, aluminum alloy, titanium, titanium alloy, magnesium, copper, or copper alloy, or combinations thereof. The four linear segments 22A, 2A, 24A, and 20A can be painted or powder coated, or combinations thereof. In some embodiments, linear segments 20A, 22A, and 24A can all have a rectangular cross-section with a size, for example, =1"×2". Front leg 2A can have the same rectangular cross-section (e.g., 1"×2"), or it can be substantially wider (e.g., 1"×3"). Note that vertical back post 22A does not extend down to the floor. Adjustable, leveling foot 7A is located at the bottom of front leg 2A.

Figure 2:
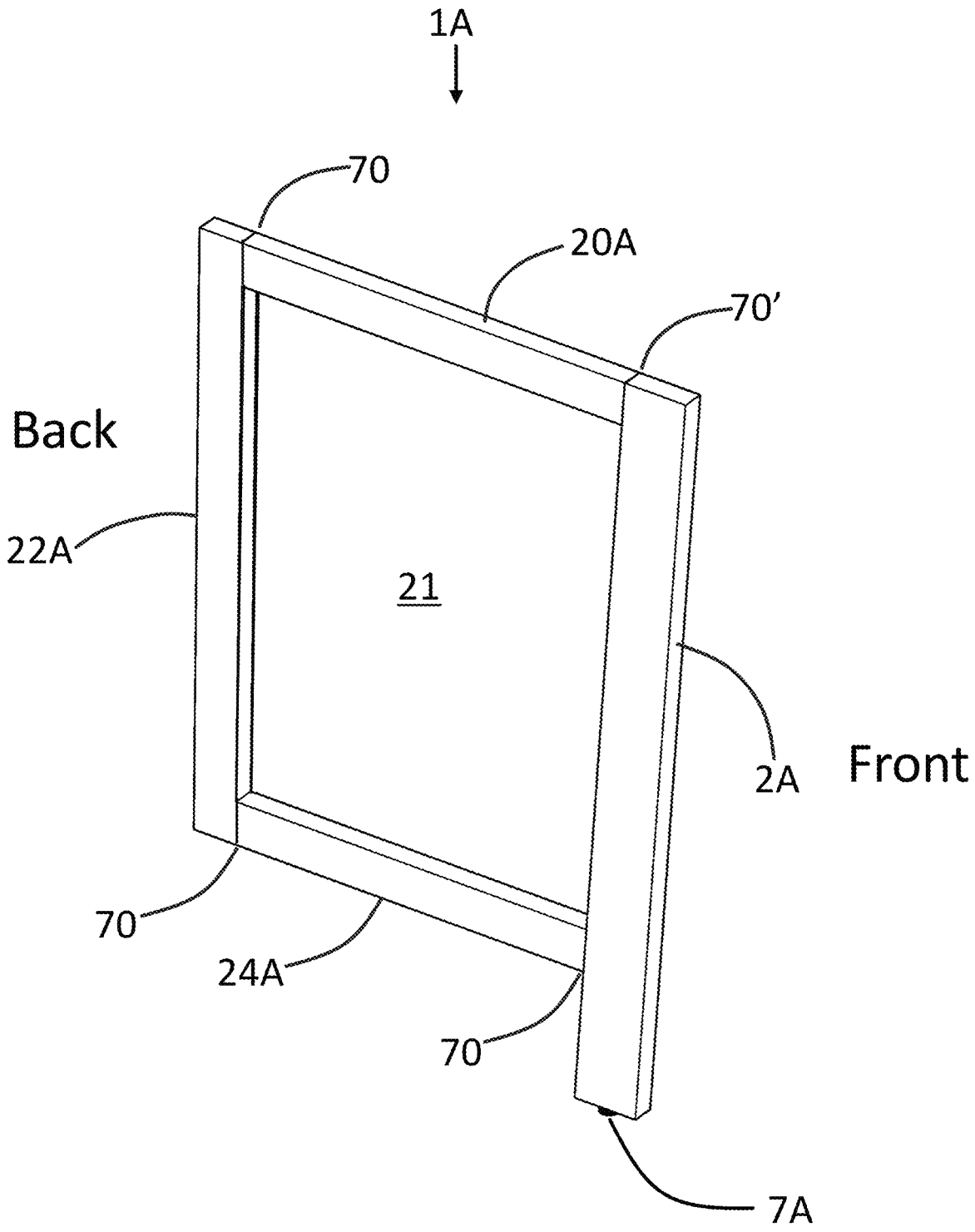
FIG. 2 shows a schematic, perspective view of an example of an open, planar subframe for a cabinet, with a backward-angled front leg, according to the present disclosure.

FIG. 2 shows a schematic, perspective view of an example of an open, planar subframe 1A for a cabinet 30, with a backward-angled front leg 2A, according to the present disclosure. Angled front leg 2A is angled backwards at an angle=θ, where θ can range from about 1 degree to about 10 degrees, with a preferred angle, θ=about 4 degrees. Subframe 1A can comprise four tubular segments that are attached together, including: vertical back post 22A, angled front leg 2A, horizontal bottom brace 24A, and horizontal top brace 20A. The four linear segments 22A, 2A, 24A, and 20A can comprise one or more welded, brazed, riveted, or mechanically attached joints 70, 70', etc. that make up subframe 1A. Central opening 21 is disposed inside of subframe 1A. Each linear segment 22A, 2A, 24A, and 20A can comprise a hollow channel (i.e., a hollow, rectangular "tube"), or a solid bar, or combinations thereof. The material used in subframe 1A can be, for example, wood, polymer, fiber-reinforced polymer, or a structural metal chosen from iron, steel, aluminum, aluminum alloy, titanium, titanium alloy, magnesium, copper, or copper alloy, or combinations thereof. The four metal segments 22A, 2A, 24A, and 20A can be painted or powder coated (e.g., black or white). Linear segments 20A, 22A, and 24A can have a rectangular cross-section of, for example, 1"×2". Front leg 2A can have the same rectangular cross-section of, for example, 1"×2", or it can be wider (e.g., 1"×3"). Note that vertical back post 22A does not extend down to the floor. Adjustable, leveling foot 7A is located at the bottom of front leg 2A.

Figure 3:
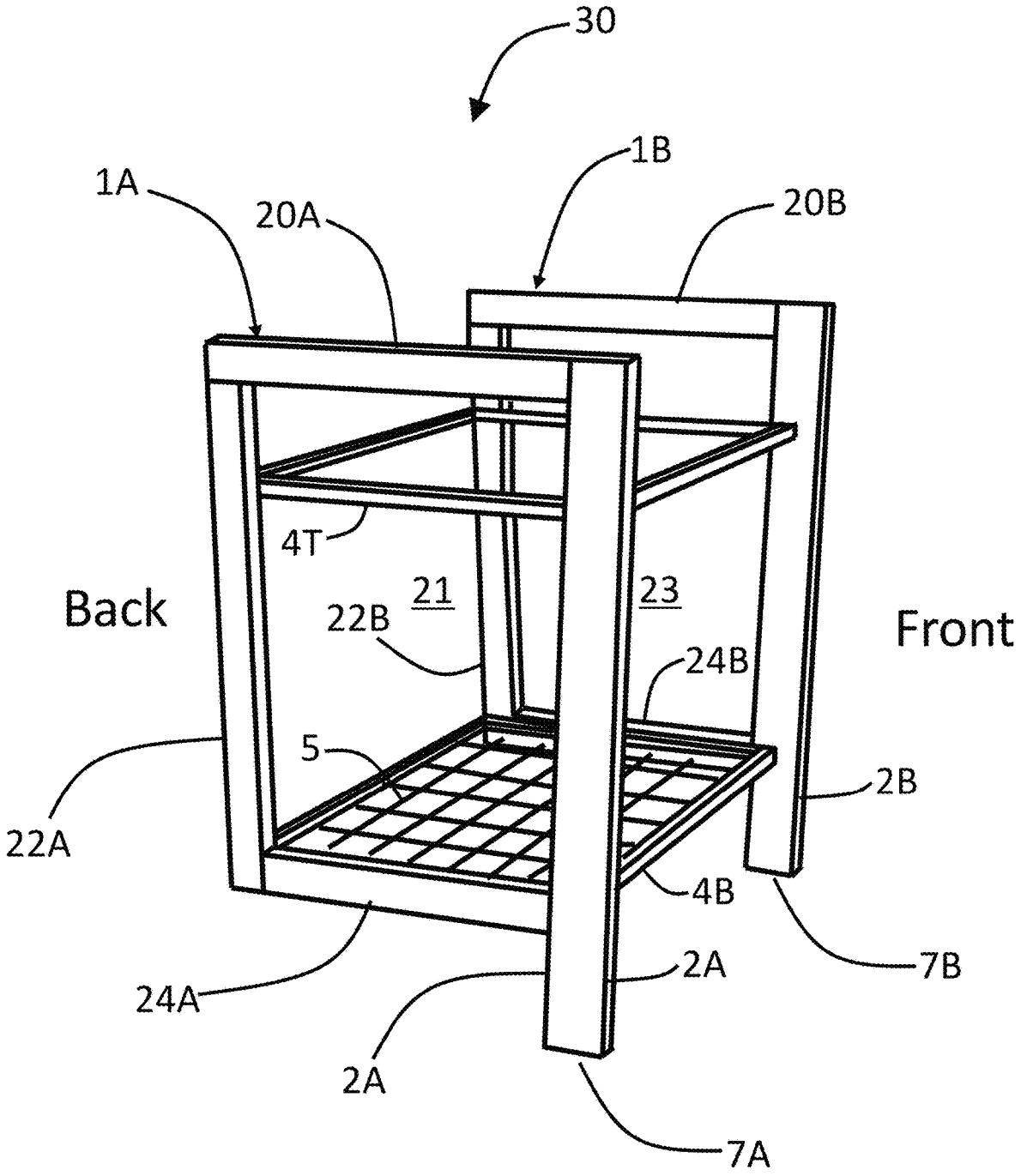
FIG. 3 shows a schematic, perspective view of an example of an open, tubular cabinet structure, with a pair of angled front legs, according to the present disclosure.

FIG. 3 shows a schematic, perspective view of an example of an open, tubular cabinet structure 30, with a pair of backward-angled front legs 2A, 2B, according to the present disclosure. Subframe 1A can comprise a first set of four linear segments that are attached together, including: first vertical back post 22A, first backward-angled front leg 2A, first horizontal bottom brace 24A, and first horizontal top brace 20A. The first set of four linear segments 22A, 2A, 24A, and 20A can be welded together or mechanically attached together to make a first four-sided subframe 1A with a first central opening 21. Adjacent subframe 2B can comprise a second set of four additional linear segments that are joined together, including: second vertical back post 22B, second backward-angled front leg 2B, second horizontal bottom brace 24B, and second horizontal top brace 20B. The second set of four linear segments 22B, 2B, 24B, and 20B can be welded together or mechanically attached together to make a second four-sided subframe 1B with a second central opening 23. The letter "A" refers to the left side of cabinet 30, and the letter "B" refers to the right side of cabinet 30. Front, adjustable leveling feet 7A and 7B are located at the bottom of front legs 2A and 2B, respectively.

Referring still to FIG. 3, subframes 1A and 1B are held in place by top horizontal support frame 4T and by bottom horizontal support frame 4B (where "T" stands for "top", and "B" stands for "bottom"). Horizontal support frames 4T and 4B can be attached to subframes 1A and 1B by screws or by welding. Frames 4T and 4B can be square or rectangular and can be made of "L"-shaped channels, e.g., 1"×1", ¾"×¾", or ½"×½", that are welded together at their respective corners. A wire mesh 5 can be attached to the bottom horizontal support frame 4B, for making a shelf that holds items. Alternatively, a solid, metal, wood or wood-composite horizontal shelf (not shown) can be attached to bottom support frame 4B in place of wire mesh 5.

Figure 4:
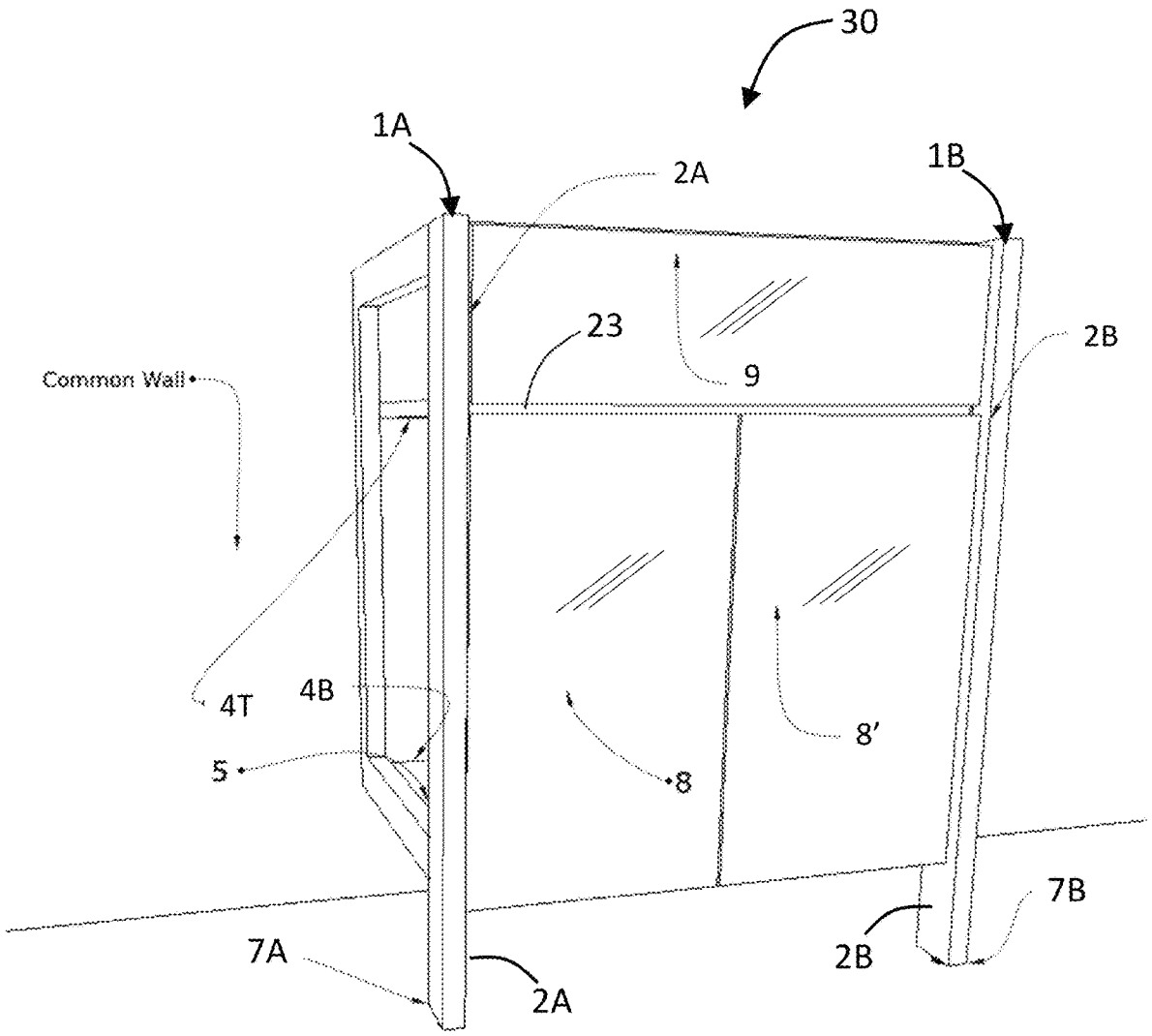
FIG. 4 shows a schematic, perspective view of an example of an open, tubular cabinet structure with hinged front doors and a false front and two angled front legs, according to the present disclosure.

FIG. 4 shows a schematic, perspective view of an example of an open, tubular cabinet structure 30 with hinged front doors 8, 8' and a false front 9 and two backward-angled front legs 2A and 2B, according to the present disclosure. There are no side or bottom panels. The dividing line between the false front 9 and the top of doors 8, 8' coincides vertically with the top horizontal support frame 4T.

Figure 5:
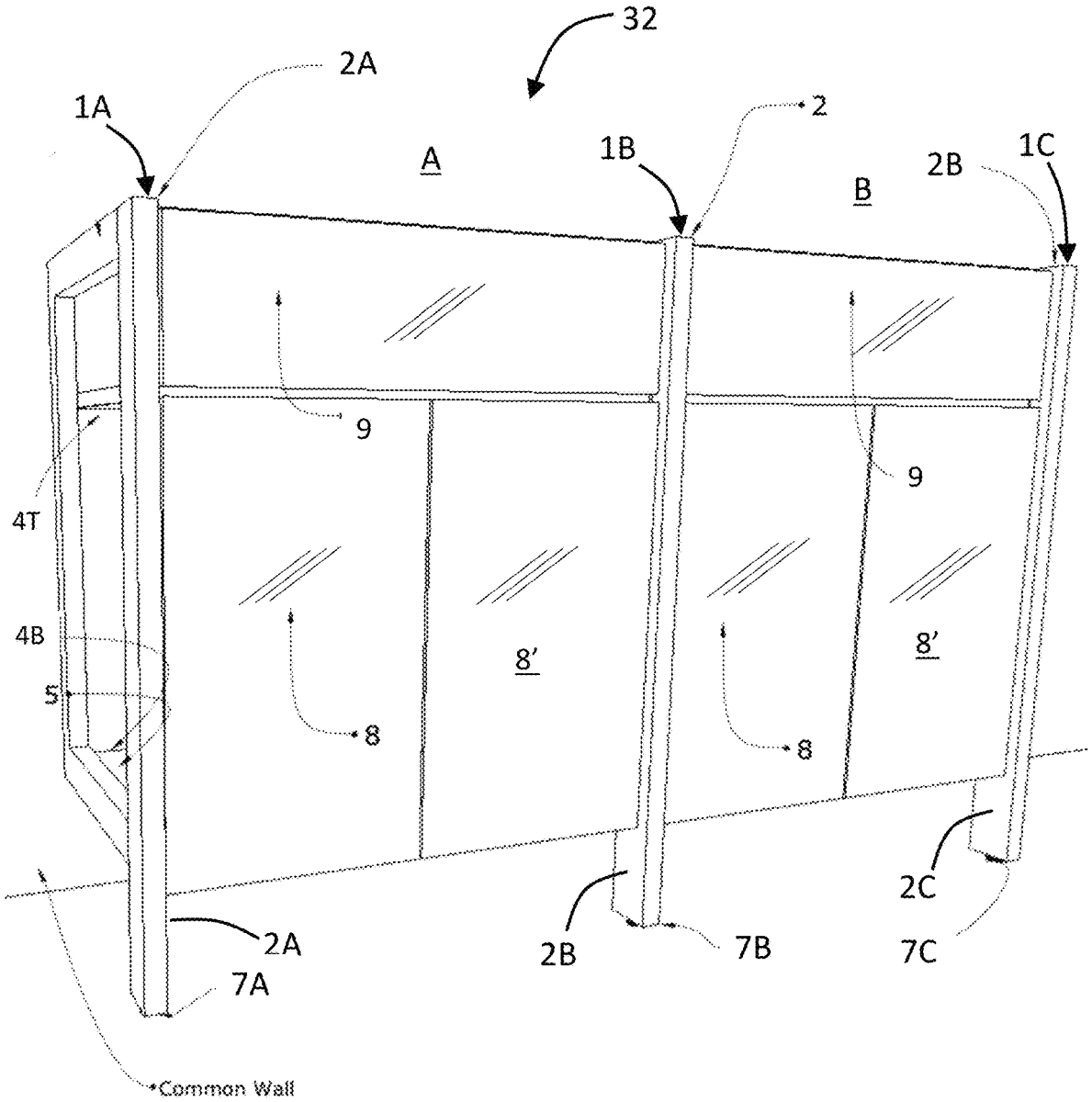
FIG. 5 shows a schematic, perspective view of an example of a pair of adjacent, open, tubular cabinet structures with hinged front doors and a false front, and angled front legs, according to the present disclosure.

FIG. 5 shows a schematic, perspective view of an example of a pair 32 of adjacent, open, tubular cabinet structures A and B, and three backward-angled front legs 2A, 2B, 2C, according to the present disclosure. Each cabinet A and B has two hinged front doors 8, 8' and a false front 9. Note that the pair 32 of adjacent cabinets A and B does not have a pair of legs 2A and 2B on each cabinet. Rather, only one subframe 1C is added when a second cabinet B is added.

Figure 6A:
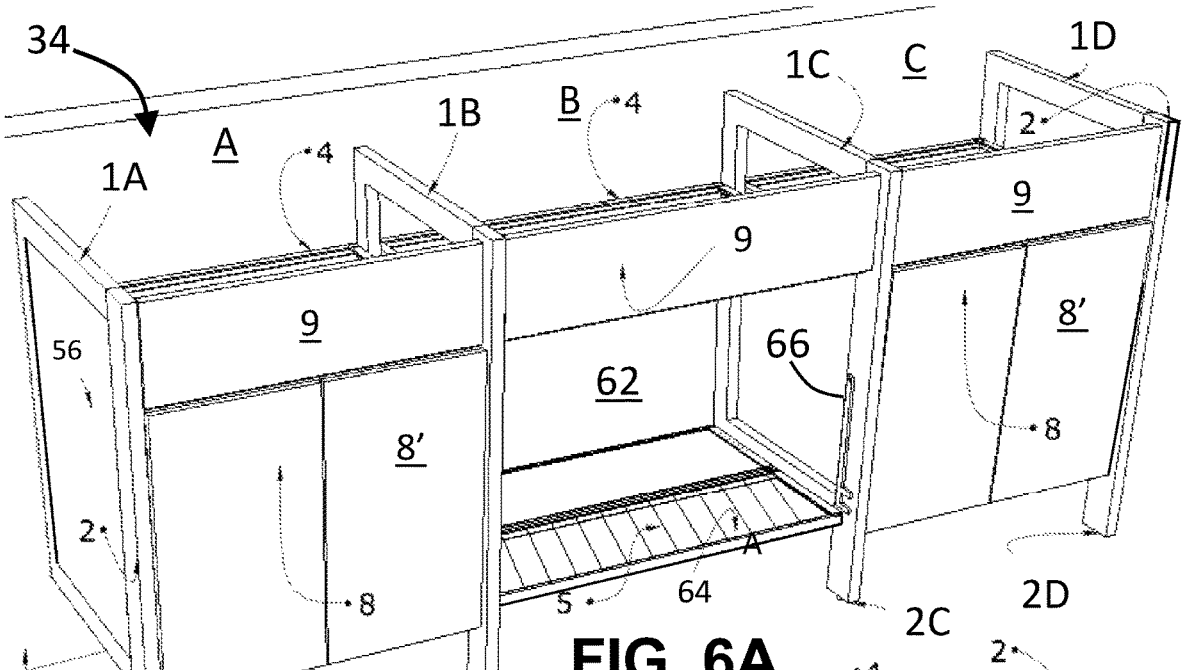
FIG. 6A shows a schematic, perspective view of an example of three adjacent, open, tubular cabinet structures with hinged front doors and false fronts, and having wheelchair access in the middle cabinet, according to the present disclosure.

FIG. 6A shows a schematic, perspective view of an example of three adjacent, open, tubular cabinet structures 34 (A, B, and C) with hinged front doors 8, 8' and false fronts 9, and having wheelchair access 62 in the extra-wide middle cabinet B, according to the present disclosure. There is a hinged bottom shelf 64 with wire mesh 5 in middle cabinet B. Hinged locking hook 66 is shown in the unlocked position.

Figure 6B:
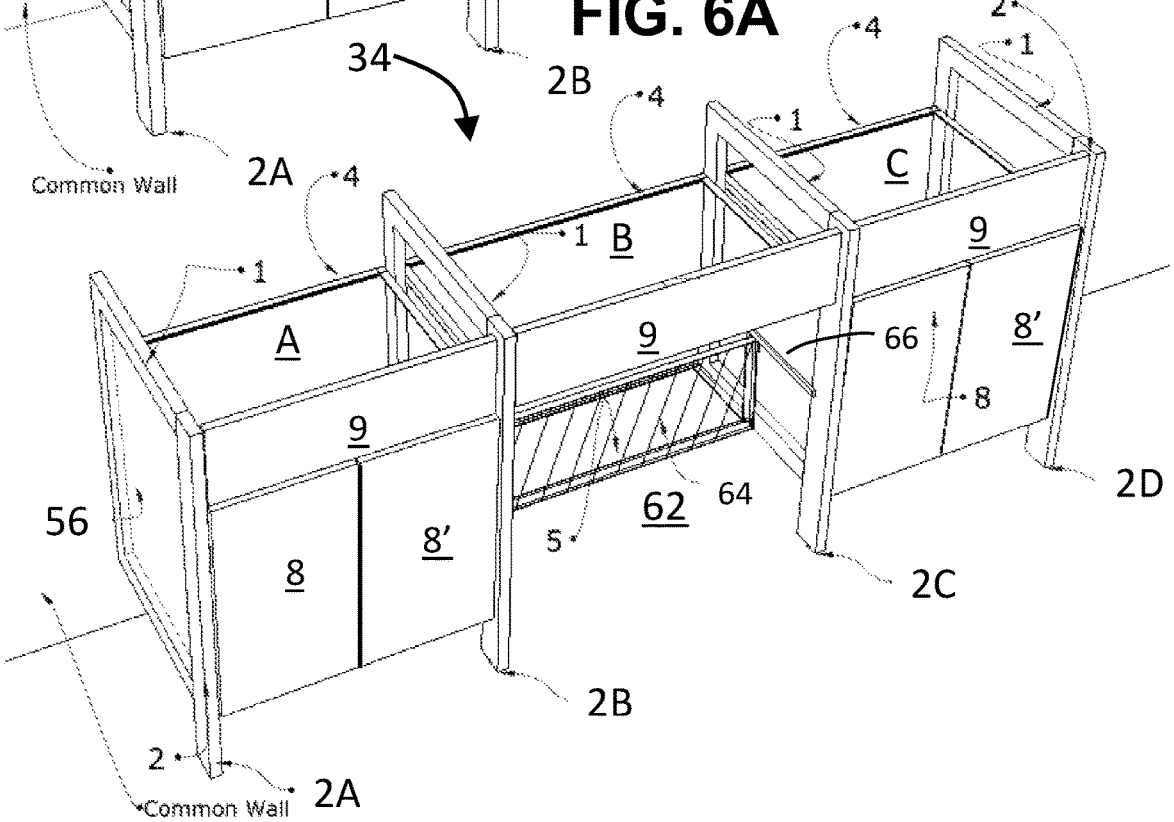
FIG. 6B shows a schematic, perspective view of an example of three adjacent, open, tubular cabinet structures with hinged front doors and a false front, and having wheelchair access in the middle cabinet, according to the present disclosure.

FIG. 6B shows a schematic, perspective view of an example of three adjacent, open, tubular cabinet structures 34 (A, B, and C) with hinged front doors 8, 8' and false fronts 9, and having wheelchair access 62 in the middle cabinet B, according to the present disclosure. The hinged bottom shelf 64 with wire mesh 5 in middle cabinet B has been rotated to a vertical position, which forms a shield to block access of the wheelchair (not shown) to hot plumbing pipes inside of open cabinet B. Hinged locking hook 66 is shown in the locked position holding shelf 64 in a vertical position.

Figure 7:
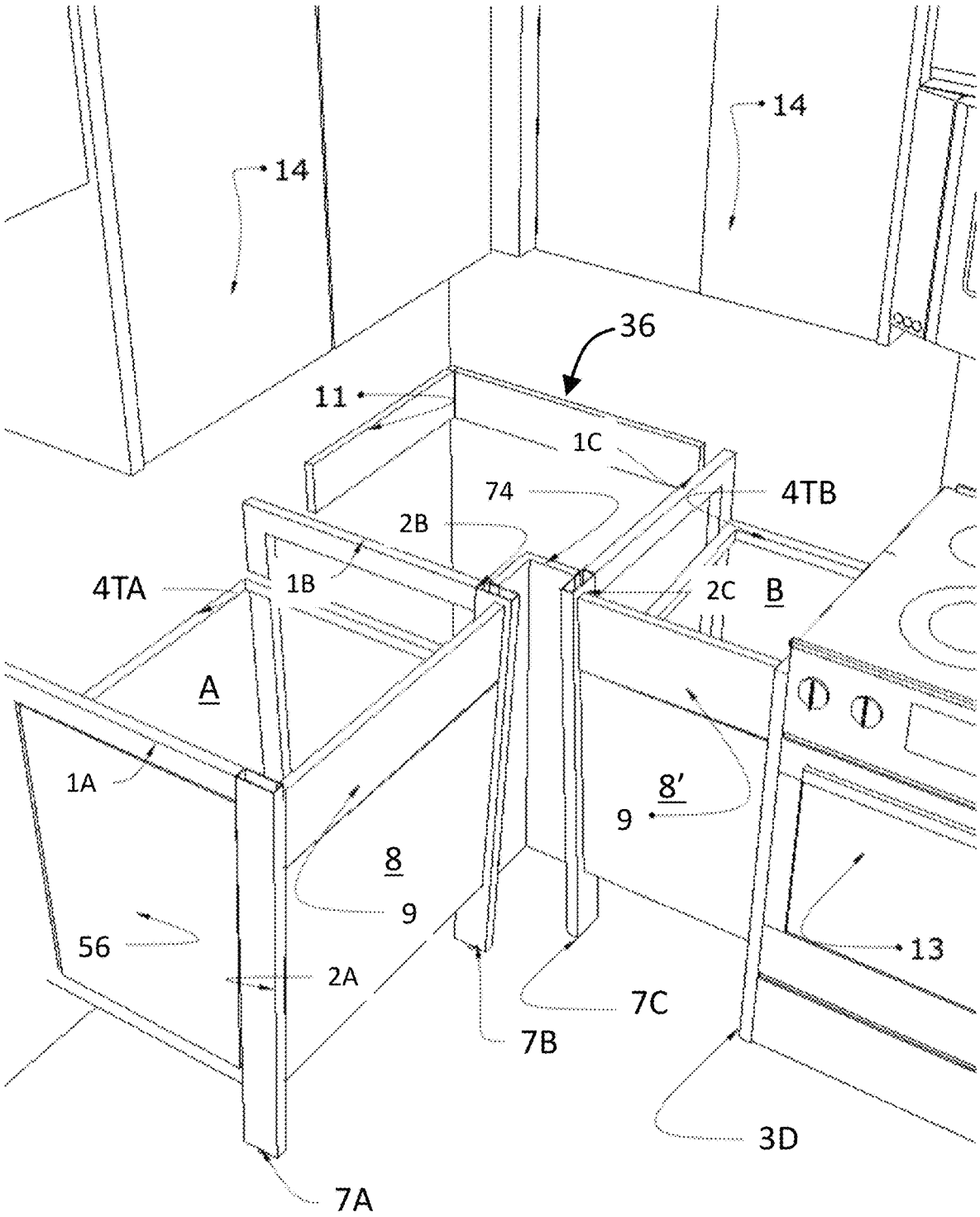
FIG. 7 shows a schematic, perspective view of an example of two open, tubular cabinet structures with hinged front doors and a false front in a corner of a kitchen, and angled front legs, according to the present disclosure.

FIG. 7 shows a schematic, perspective view of an example of a corner kitchen layout 36 of two open, tubular cabinet structures A and B with hinged front doors 8, 8' and a false front 9 in a corner of a kitchen, with backward-angled front legs 2, according to the present disclosure. Horizontal ledger board 11 is placed in the corner of kitchen layout 36 to support a countertop (not shown). Vertical filler piece 74 (which can be made of wood or metal), is placed in between cabinets A and B at the corner. Note that cabinet B next door to oven 13 has a right straight leg 3, instead of a backward-angled front leg 2.

Figures 8A, 8B:
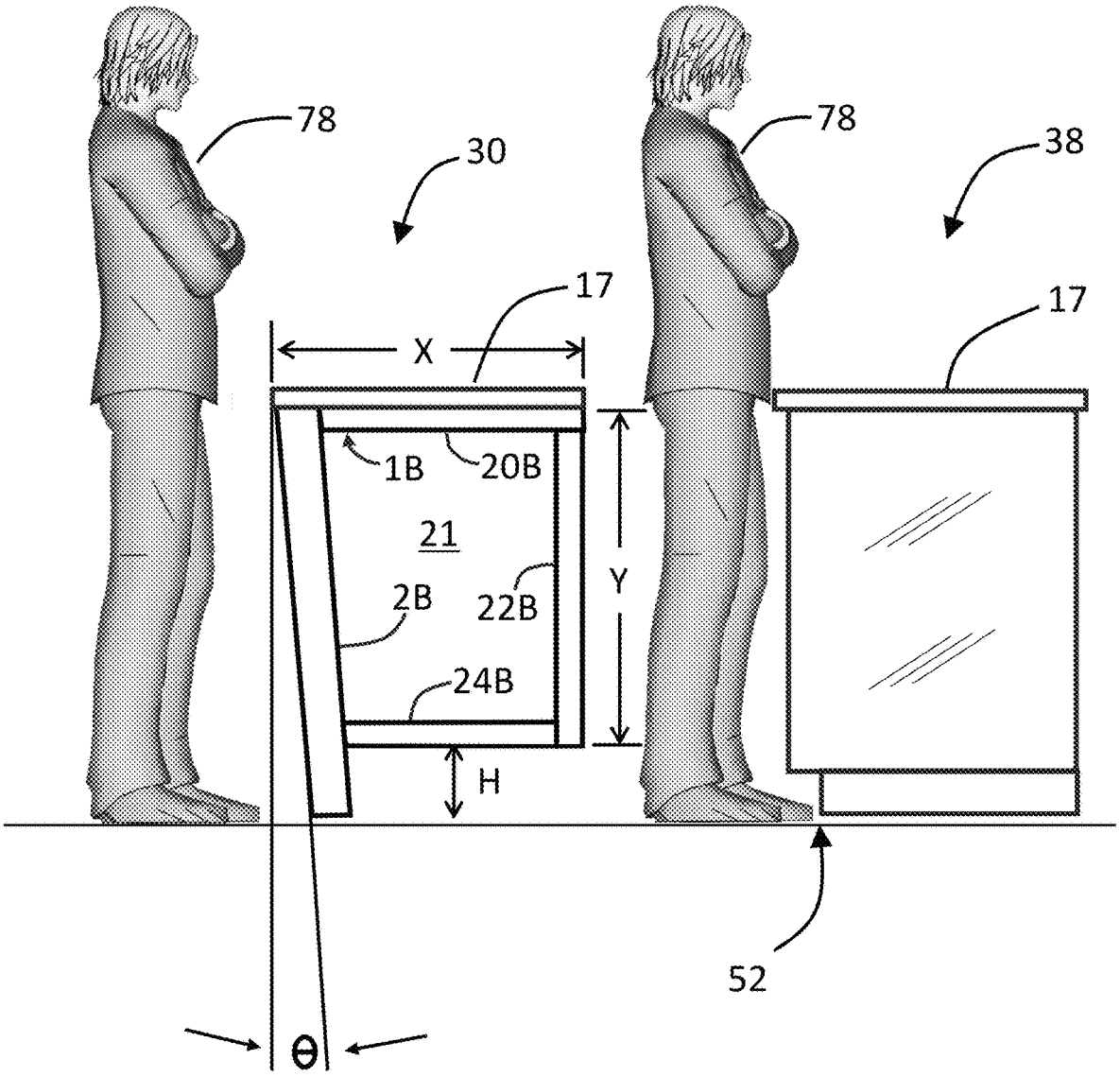
FIG. 8A shows a schematic, side view of an example of an open, tubular cabinet structure with a subframe and a backward-angled front leg, according to the present disclosure.
FIG. 8B shows a schematic, side view of a traditional cabinet with a toe kick space.

FIG. 8A shows a schematic, side view of an example of an open, tubular cabinet structure 30 with subframe 1B and a backward-angled front leg 2B, according to the present disclosure. Front leg 2B is recessed backwards at a recess angle, θ, thereby providing 3" of horizontal room at the floor level for the toes of a person 78 standing close to cabinet 30. Note, also, that the backward-angled front leg 2B (and backward-angled attached hinged front doors and false front (not shown)) do not catch any spills that run off of countertop 17. In this example, subframe 1B has an opening 21 in the side of subframe 1B. Bottom horizontal brace 24B is located a vertical height=H above the floor. The vertical height, H, can range from 4-8", with a preferred height=6". The vertical height, Y, of vertical back post 22B can range from 26" to 30", with a preferred height=28-½". The horizontal width, X, of top horizontal brace 20B can range from 6" to 42" with a preferred width=24".

FIG. 8B shows a schematic, side view of a typical cabinet 38 with a standard toe kick space 52 that is recessed horizontally 3" and vertically 4½". The purpose of toe kick space 52 is to allow person 78 to stand closer to countertop 17 without hitting cabinet 38 with his feet.

Figure 9:
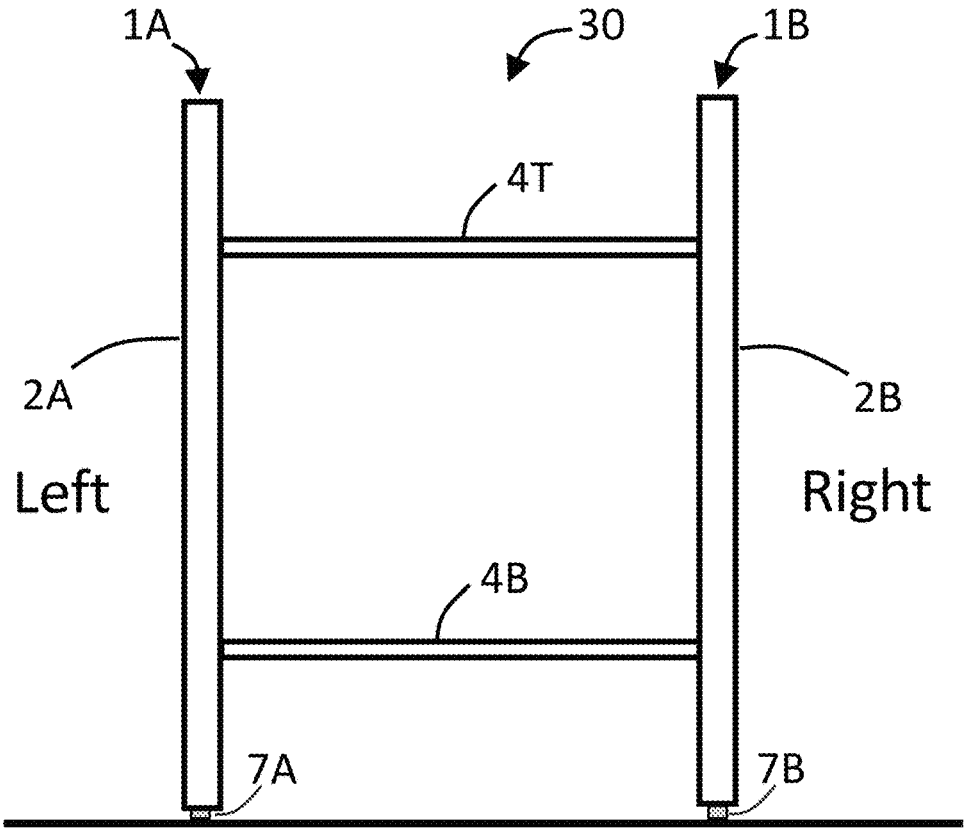
FIG. 9 shows a schematic, front view of an example of an open, tubular cabinet structure, and angled (or straight) front legs, according to the present disclosure.

FIG. 9 shows a schematic, front view of an example of an open, tubular cabinet structure 30, and backward-angled (or straight) front legs 2A and 2B, according to the present disclosure. Top and bottom horizontal frames 4T and 4B, respectively, support and hold together the two subframes 1A and 1B. Front, adjustable leveling feet 7A and 7B are shown.

Figure 10:
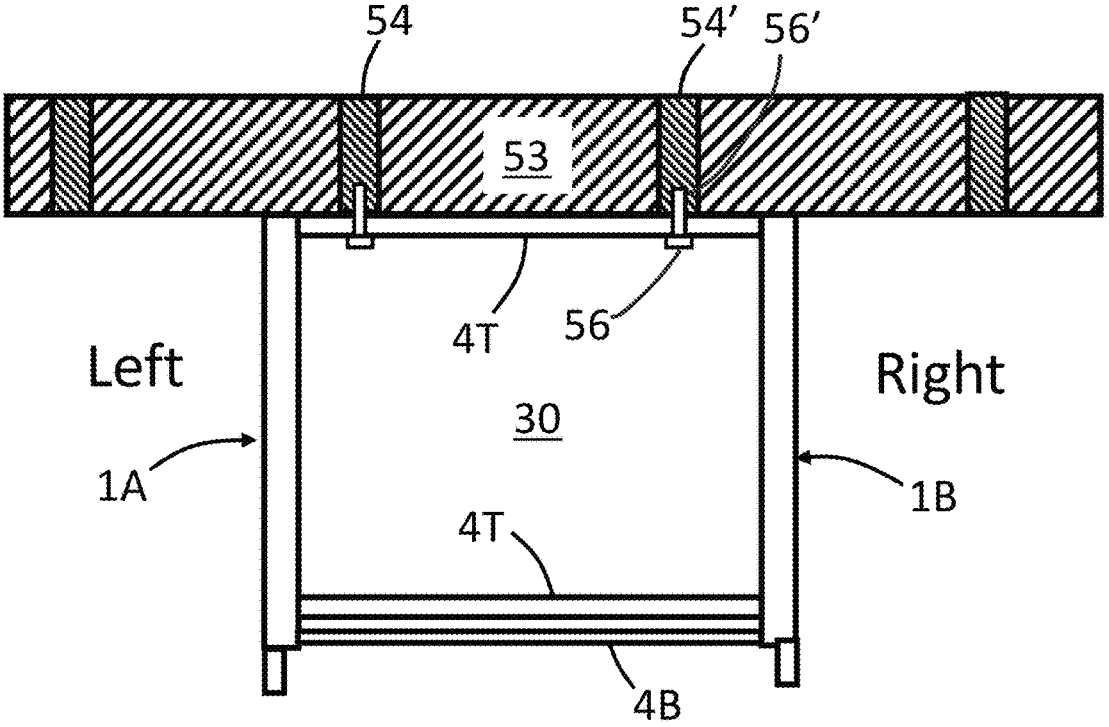
FIG. 10 shows a schematic, top view of an example of an open, tubular cabinet structure attached to a wall, with a pair of subframes, according to the present disclosure.

FIG. 10 shows a schematic, top view of an example of an open, tubular cabinet structure 30 attached to a wall 53, with a pair of subframes 1A and 1B, according to the present disclosure. Cabinet 30 can be attached to studs 54 and 54' in wall 53 with screws 56 and 56', respectively. Other attachment schemes can be used, including tapered ledger boards (not shown). Top and bottom horizontal frames 4T and 4B, respectively, support and hold together the two subframes 1A and 1B. In one embodiment, screws 56 and 56' go through the top horizontal frame 4T. Optionally, additional screws 56 and 56' could also go through the bottom horizontal frame 4B to attach cabinet 30 to studs 54 and 54', respectively.

Figure 11:
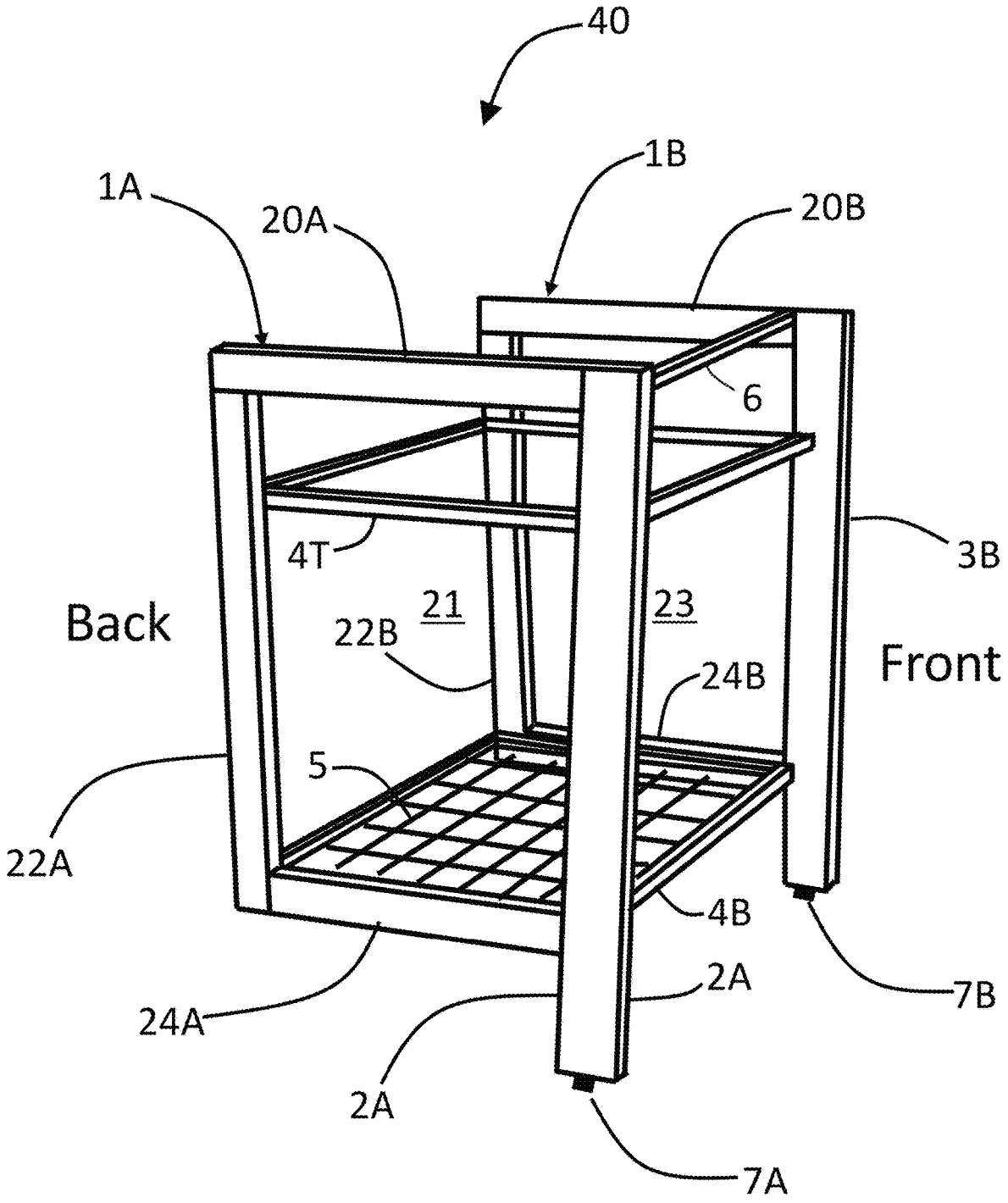
FIG. 11 shows a schematic, perspective view of an example of an open, tubular cabinet structure, with a backward-angled front leg on the left side and a straight leg on the right side, according to the present disclosure.

FIG. 11 shows a schematic, perspective view of an example of an open, tubular cabinet structure 40, with a backward-angled front leg 2A on the left side and a straight leg 3B on the right side, according to the present disclosure. Subframe 1A can comprise four segments that are attached together: vertical back post 22A, backward-angled front leg 2A, horizontal bottom brace 24A, and horizontal top brace 20A. The four segments 22A, 2A, 24A, and 20A can be welded together or mechanically attached together to make subframe 1A. Adjacent subframe 2B can comprise four additional segments that are attached together: vertical back post 22B, straight front leg 3B, horizontal bottom brace 24B, and horizontal top brace 20B. The four segments 22B, 3B, 24B, and 20B can be welded together or mechanically attached together to make subframe 1B. The letter "A" refers to the left side of cabinet 40, and the letter "B" refers to the right side of cabinet 40. Front, adjustable leveling feet 7A and 7B are located at a bottom of front legs 2A and 3B, respectively.

Referring still to FIG. 11, subframes 1A and 1B are held in place by top horizontal support frame 4T and by bottom horizontal support frame 4B (where "T" stands for "top", and "B" stands for "bottom"). Horizontal support frames 4T and 4B can be attached to subframes 1A and 1B by screws or by welding. Frames 4T and 4B can be square or rectangular and can be made of "L"-shaped corner channels, e.g., 1"×1", ¾"×¾", or ½"×½", that are welded together at their respective corners. A wire mesh 5 can be attached to the bottom horizontal support frame 4B, for making a shelf that holds items. Alternatively, a solid, metal or wood or composite horizontal plate (not shown) can be attached to bottom support frame 4B in place of wire mesh 5. Horizontal support bar 6, which spans across first subframe 1A to second subframe 1B, can be attached to the top of front legs 2A and 3B to support a false front panel (not shown).

Figure 12A:
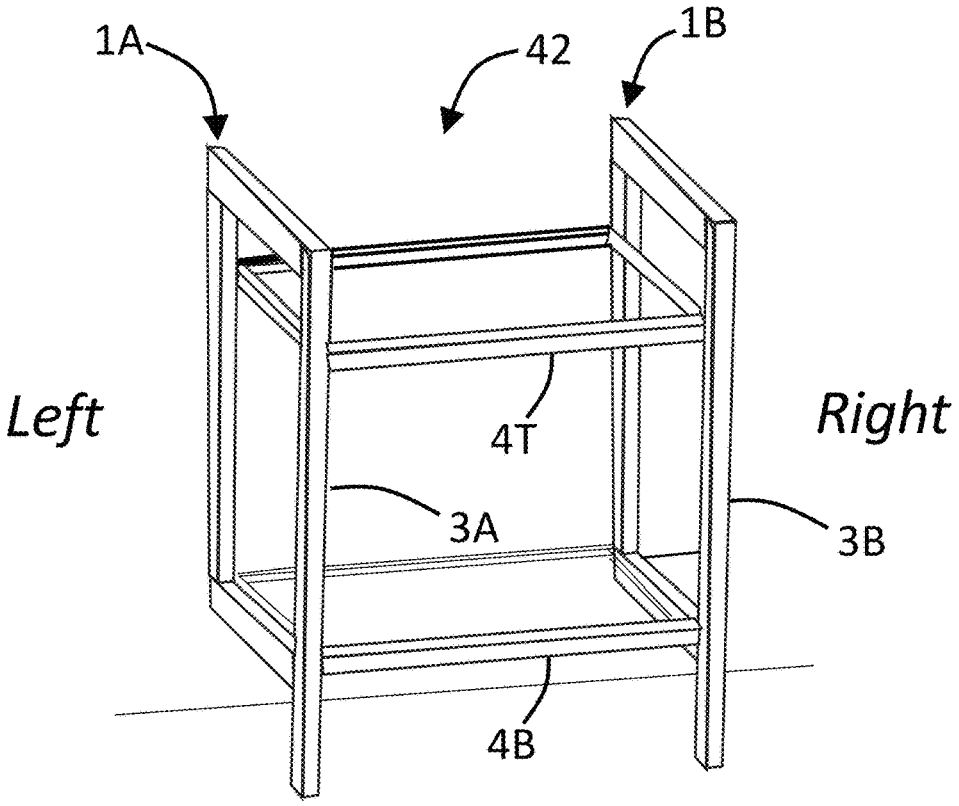
FIG. 12A shows a schematic, perspective view of an example of an open, tubular cabinet structure, with a pair of straight front legs, according to the present disclosure.

FIG. 12A shows a schematic, perspective view of an example of an open, tubular cabinet structure 42, with a pair of straight front legs 3A and 3B, according to the present disclosure. Horizontal support frames 4T and 4B hold together vertical subframes 1A and 1B.

Figure 12B:
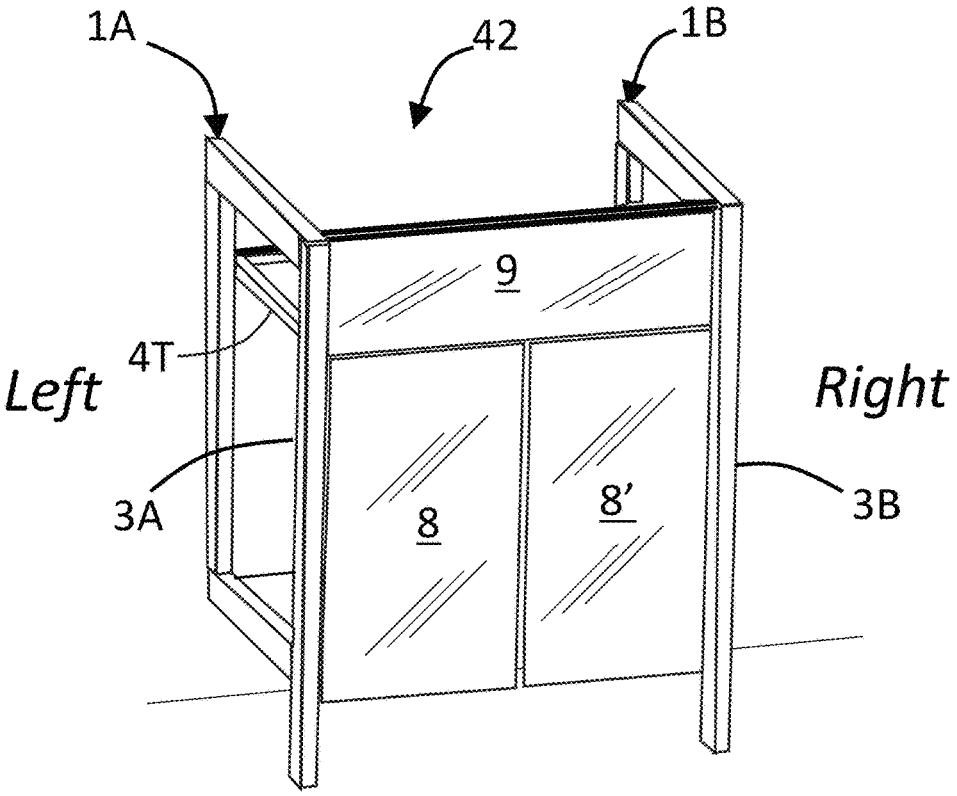
FIG. 12B shows a schematic, perspective view of an example from FIG. 12A of an open, tubular cabinet structure, with a pair of straight front legs, and door and false front panels, according to the present disclosure.
Figure 13A:
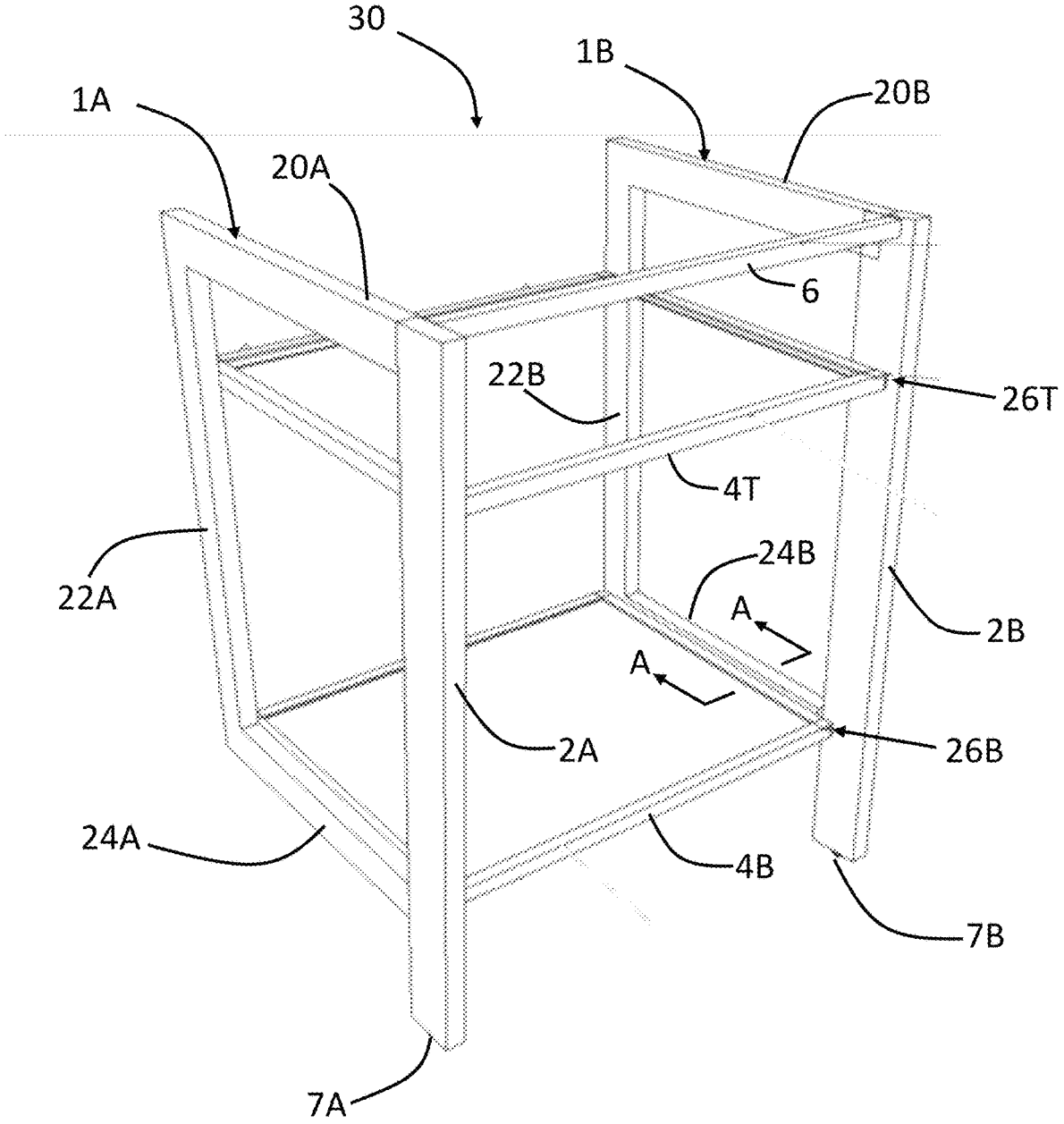
FIG. 13A shows a schematic, perspective view of an example of an open, tubular cabinet structure, with a pair of angled front legs and two, horizontal, support frames, according to the present disclosure.

FIG. 12B shows a schematic, perspective view of an example from FIG. 12A of an open, tubular cabinet structure 42, with a pair of straight front legs 3A and 3B, and hinged door panels 8, 8' and false front panel 9, according to the present disclosure. Horizontal top frame 4T holds together left and right subframes 1A and 1B, respectively, FIG. 13A shows a schematic, perspective view of an example of an open, tubular cabinet structure 30, with a pair of backward-angled front legs 2A and 2B, and two, horizontal, support frames 4T and 4B, according to the present disclosure. Subframe 1A can comprise four segments that are attached together, including: vertical back post 22A, backward-angled front leg 2A, horizontal bottom brace 24A, and horizontal top brace 20A. The four segments 22A, 2A, 24A, and 20A can be welded together or mechanically attached together to make subframe 1A. Adjacent subframe 2B can comprise four additional segments that are attached together, including: vertical back post 22B, backward-angled front leg 2B, horizontal bottom brace 24B, and horizontal top brace 20B. The four segments 22B, 2B, 24B, and 20B can be welded, brazed, riveted, or mechanically attached together to make subframe 1B. The letter "A" refers to the left side of cabinet 30, and the letter "B" refers to the right side of cabinet 30. Front, adjustable leveling feet 7A and 7B are located at the bottom of backward-angled front legs 2A and 2B, respectively.

Referring still to FIG. 13A, subframes 1A and 1B are held in place by top horizontal support frame 4T and by bottom horizontal support frame 4B (where "T" stands for "top", and "B" stands for "bottom"). Horizontal support frames 4T and 4B can be attached to subframes 1A and 1B by screws or by welding. Frames 4T and 4B can be square or rectangular and can be made of "L"-shaped corner channels, e.g., 1"×1", ¾"×¾", or ½"×½", that are welded together at their respective corners.

Figure 13B:
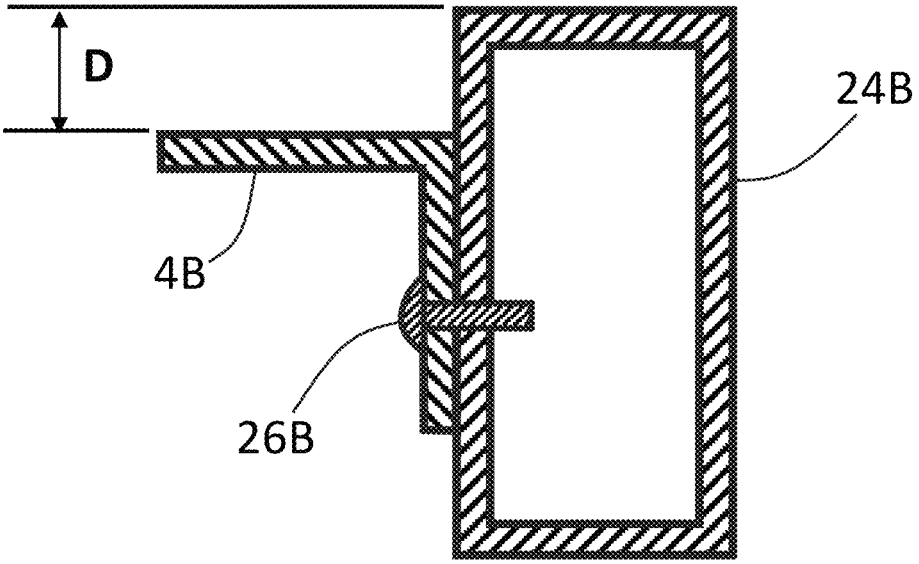
FIG. 13B shows a schematic, cross-section view (Section A-A) of an example of a horizontal, support frame attached to a horizontal bottom brace, according to the present disclosure.

FIG. 13B shows a schematic, cross-section view (Section A-A) of an example of a horizontal, support frame 4B attached to a horizontal bottom brace 24B, according to the present disclosure. Horizontal support frame 4B can be attached to horizontal bottom brace 24B with screw 26B. In this example, horizontal bottom brace 24B is a hollow, rectangular tube. Horizontal support frame 4B can be a L-shaped channel, or a square-shaped channel (tube). Horizontal support frame 4B can be vertically offset from horizontal bottom brace 24B. The vertical distance, D, from the top of frame 4B to the top of bottom brace 24B can range from 0" to 1", with a preferred distance, D=½".

Figure 14:
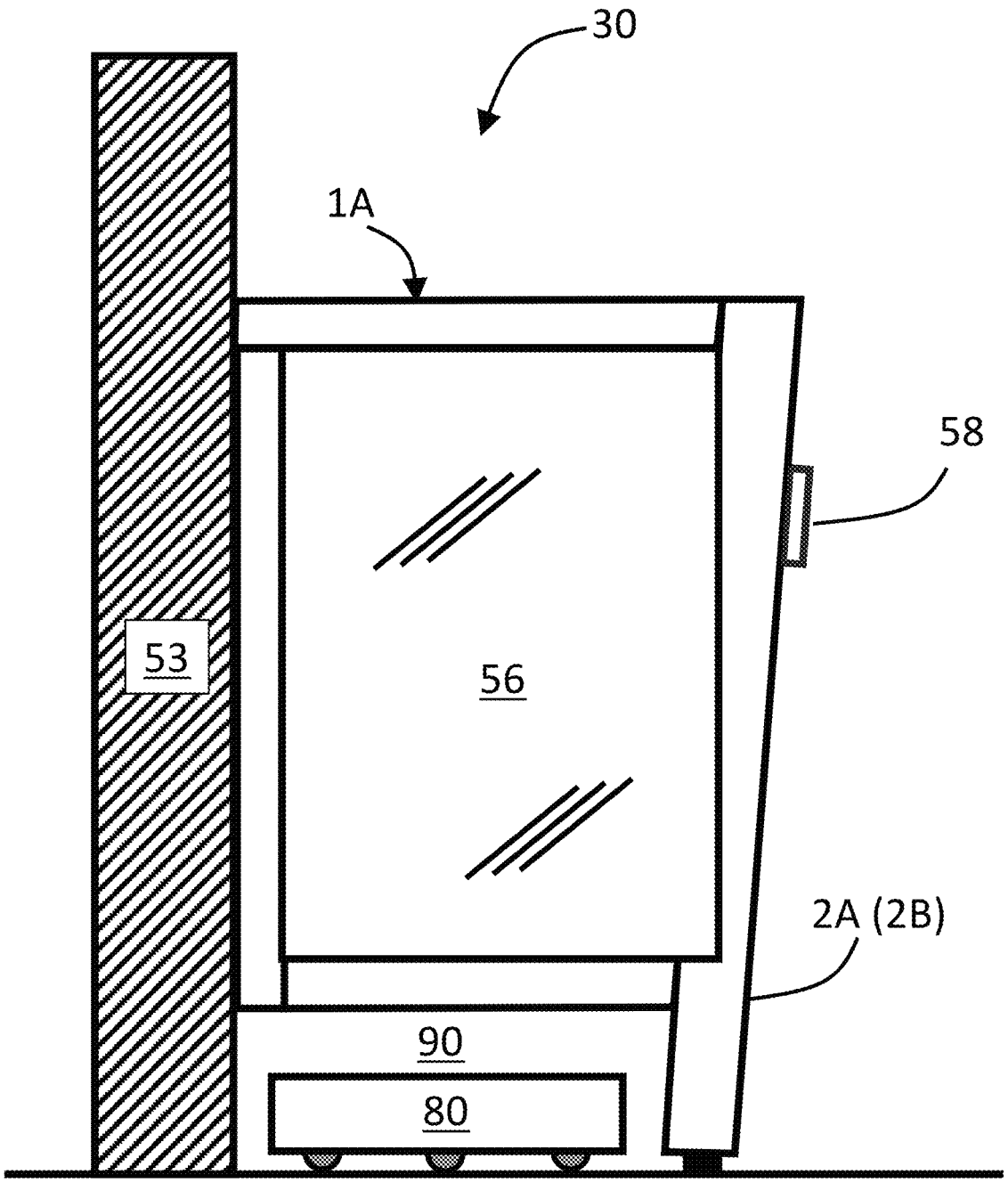
FIG. 14 shows a schematic, front view of an example of a tubular cabinet structure attached to a wall, with an attached side panel and angled front legs, according to the present disclosure.

FIG. 14 shows a schematic, front view of an example of a tubular cabinet structure 30 attached to a wall 53, with an attached side panel 56 and backward-angled front legs 2A (2B), according to the present disclosure. Handles 58 to front door panels (not shown) can be seen. Robot vacuum unit 80 can be stored in open space 90 directly underneath cabinet 30 (wherein the height of open space 90 can be 6" tall).

Figure 15:
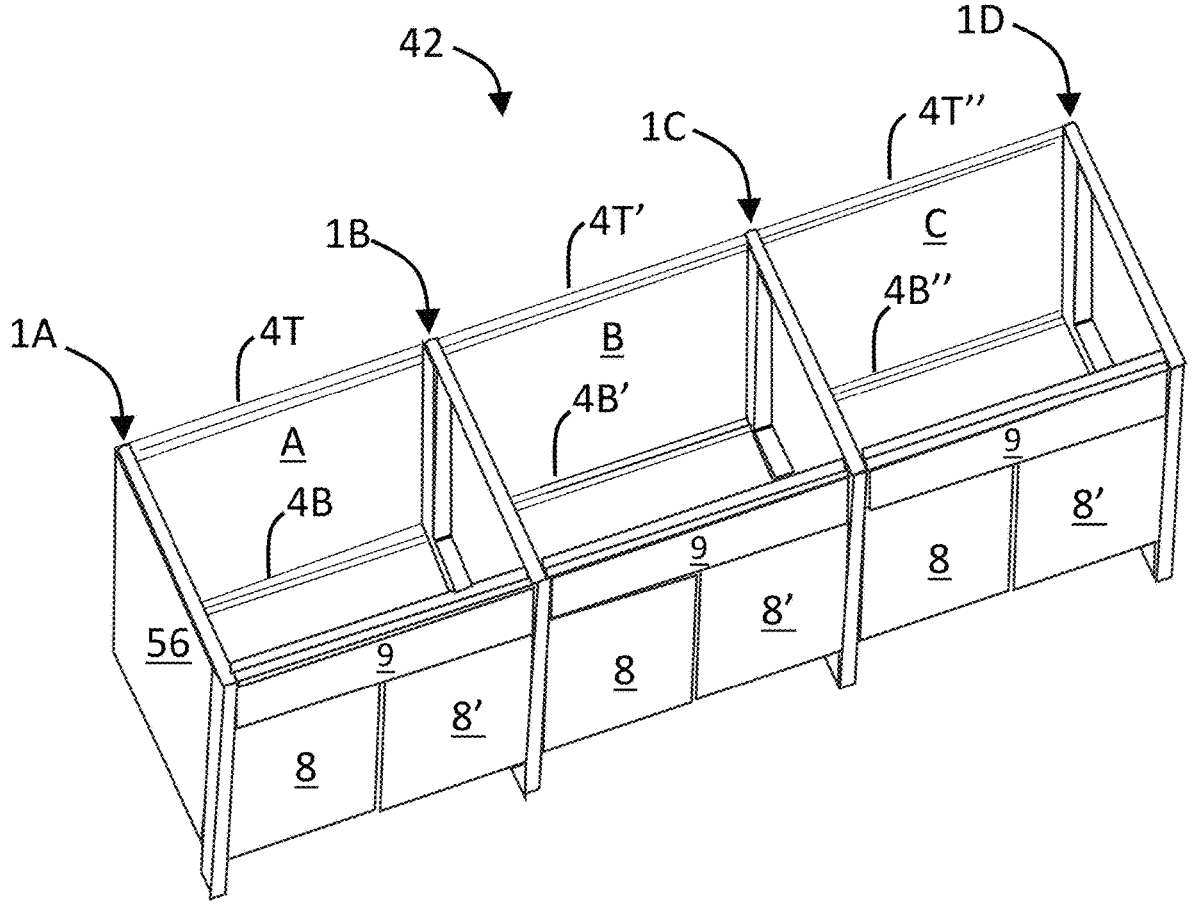
FIG. 15 shows a schematic, perspective view of an example of three adjacent, open, tubular cabinet structures with hinged front doors and false fronts, according to the present disclosure.

FIG. 15 shows a schematic, perspective view of an example of three adjacent, open, tubular cabinet structures 42 (A, B, C) with hinged front doors 8, 8' and false fronts 9, according to the present disclosure. Each pair of adjacent cabinets has its own shared, common subframe. For example, cabinets A and B share common subframe 1B. Also, cabinets B and C share common subframe 1C. Pairs of adjacent subframes (e.g., 1A and 1B) are held together by horizontal top frame 4T and horizontal bottom frame 4B, etc. In this example, top frame 4T is located flush with the top surface of cabinet 42. Hinged door panels 8, 8' and false front 9 are shown. The left end of cabinet 42 can have a solid, finish side panel 56. Otherwise, the back, bottom, and top sides of the cabinets are open and not covered by a panel.

Figure 16:
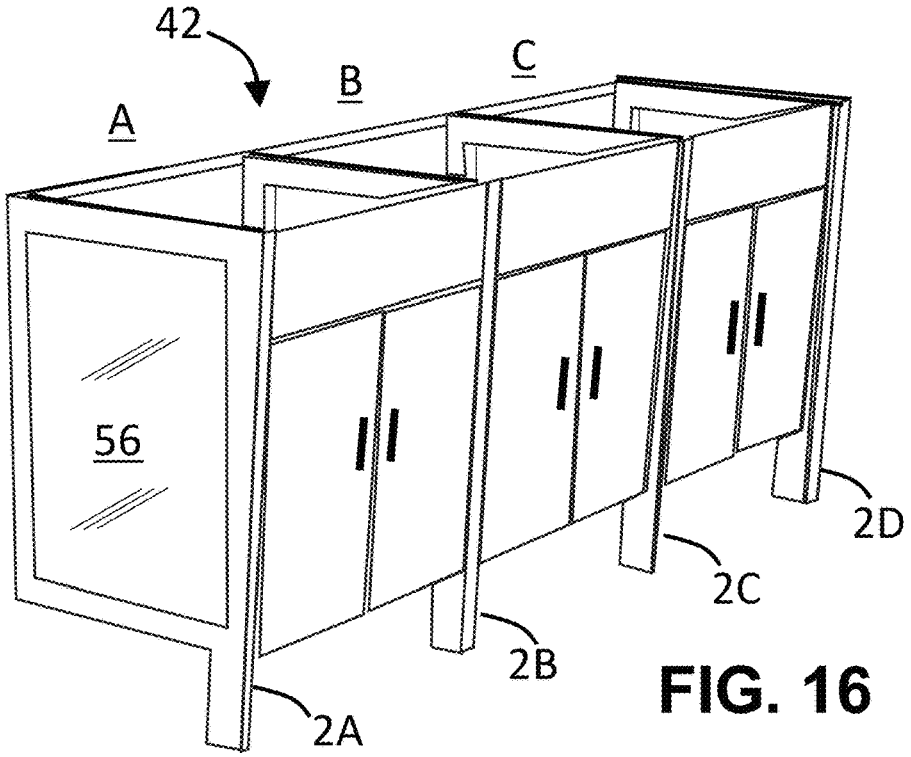
FIG. 16 shows a schematic, perspective view of an example of three adjacent, open, tubular cabinet structures with hinged front doors and false fronts, according to the present disclosure.

FIG. 16 shows a schematic, perspective view of an example of three adjacent, open, tubular cabinet structures 42 (A, B, C) with hinged front doors 8, 8' and false fronts 9, according to the present disclosure. Backward-angled front legs 2A, 2B, 2C, and 2D are shown.

Figure 17:
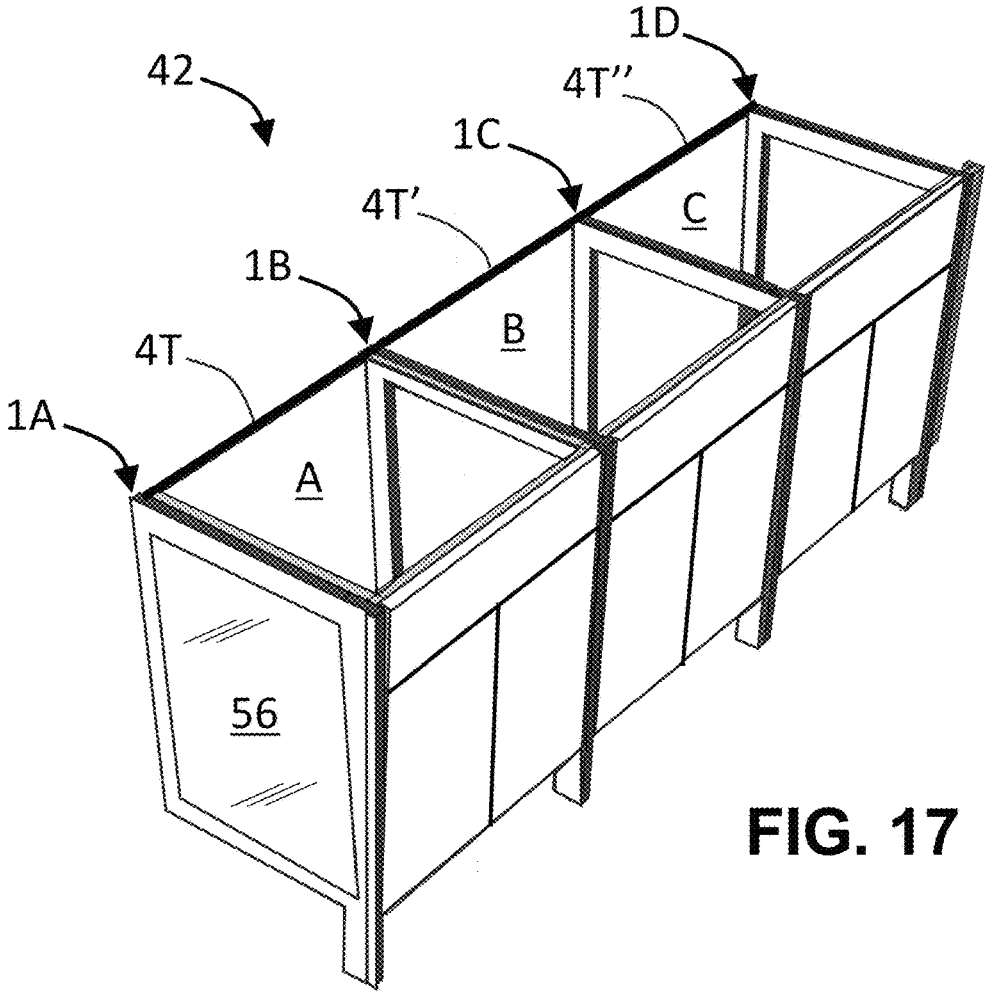
FIG. 17 shows a schematic, perspective view of an example of three adjacent, open, tubular cabinet structures with hinged front doors and false fronts, according to the present disclosure.

FIG. 17 shows a schematic, perspective view of an example of three adjacent, open, tubular cabinet structures with hinged front doors and false fronts, according to the present disclosure. Subframes 1A, 1B, 1C, and 1D are shown.

Figure 18:
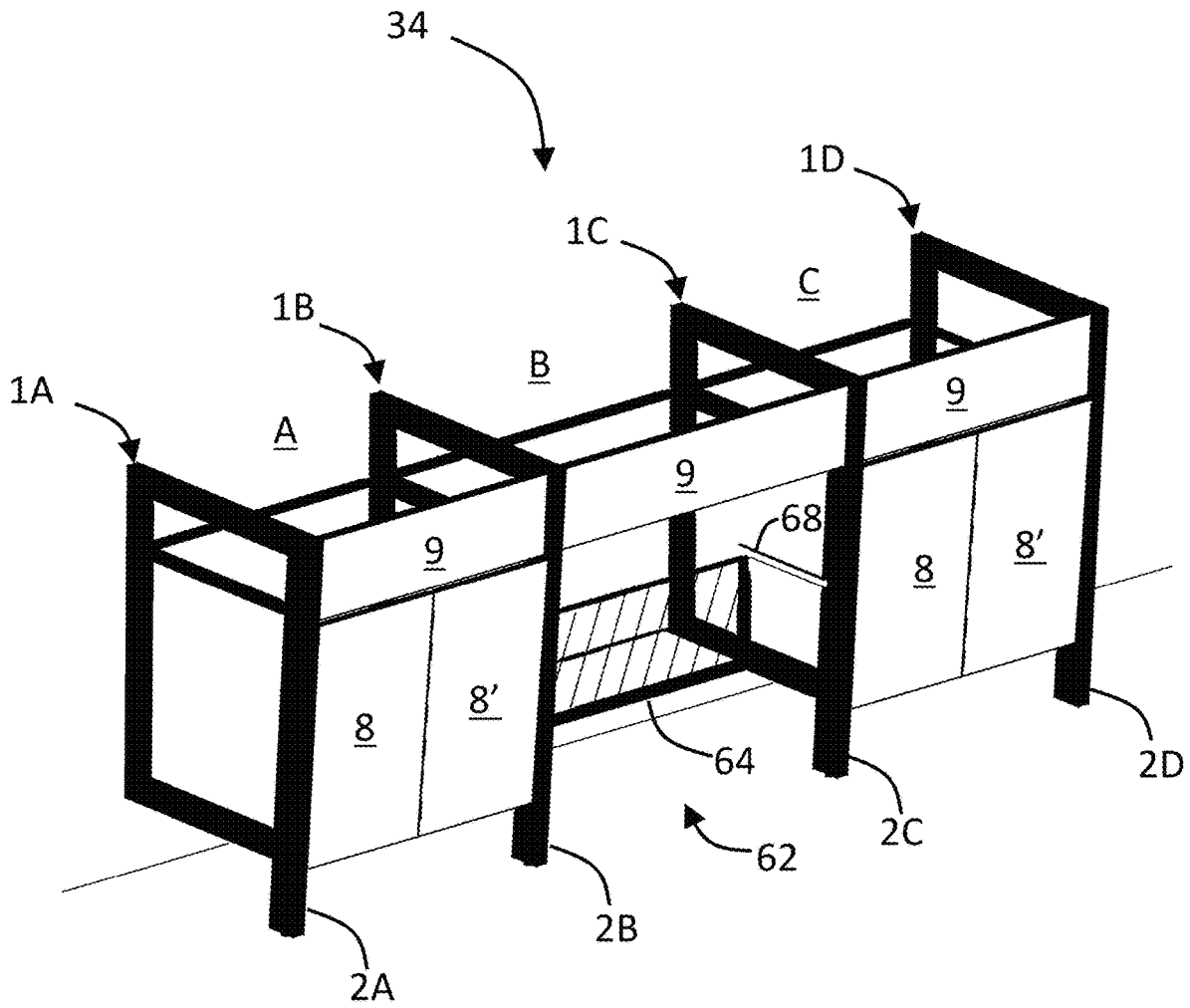
FIG. 18 shows a schematic, perspective view of an example of three adjacent, open, tubular cabinet structures with hinged front doors and false fronts, and having wheelchair access in the middle cabinet, according to the present disclosure.

FIG. 18 shows a schematic, perspective view of an example of three adjacent, open, tubular cabinet structures 34 (A, B, and C D) with hinged front doors 8, 8' and false fronts 9, and having wheelchair access 62 in the middle cabinet B, according to the present disclosure. The hinged bottom shelf 64 with wire mesh 5 in middle cabinet B has been rotated to a vertical position, which forms a shield to block access of the wheelchair (not shown) to hot plumbing pipes inside of open cabinet B. Hinged locking hook 66 is shown in the locked position holding shelf 64 in a vertical position.

Figure 19:
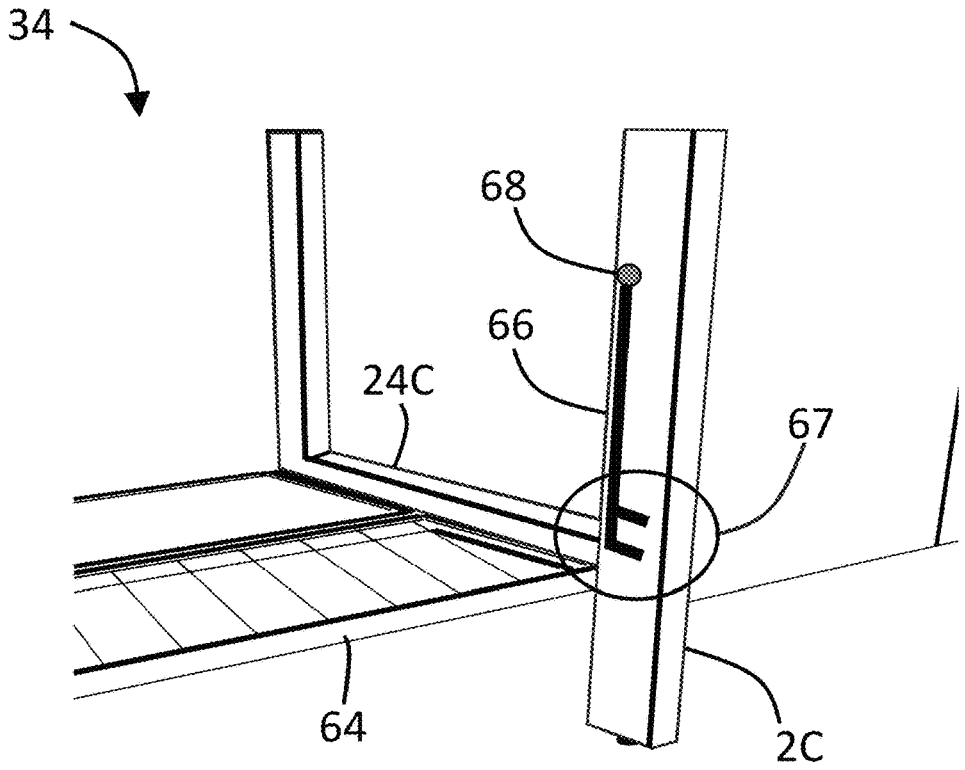
FIG. 19 shows a schematic, perspective, enlarged view of an example of an open, tubular cabinet structure with wheelchair access in the middle cabinet, showing a metal mesh shelf in the down position, according to the present disclosure.

FIG. 19 shows a schematic, perspective, enlarged view of an example of an open, tubular cabinet structure 34 with wheelchair access 62 in the middle cabinet B, showing a metal mesh shelf 64 in the down position, according to the present disclosure. Note that the front edge of mesh shelf 64 is recessed from the front edge of backward-angled front leg 2C. Locking bar 66, with hinge 68 and "F"-shaped locking end 67 can be seen.

Figure 20:
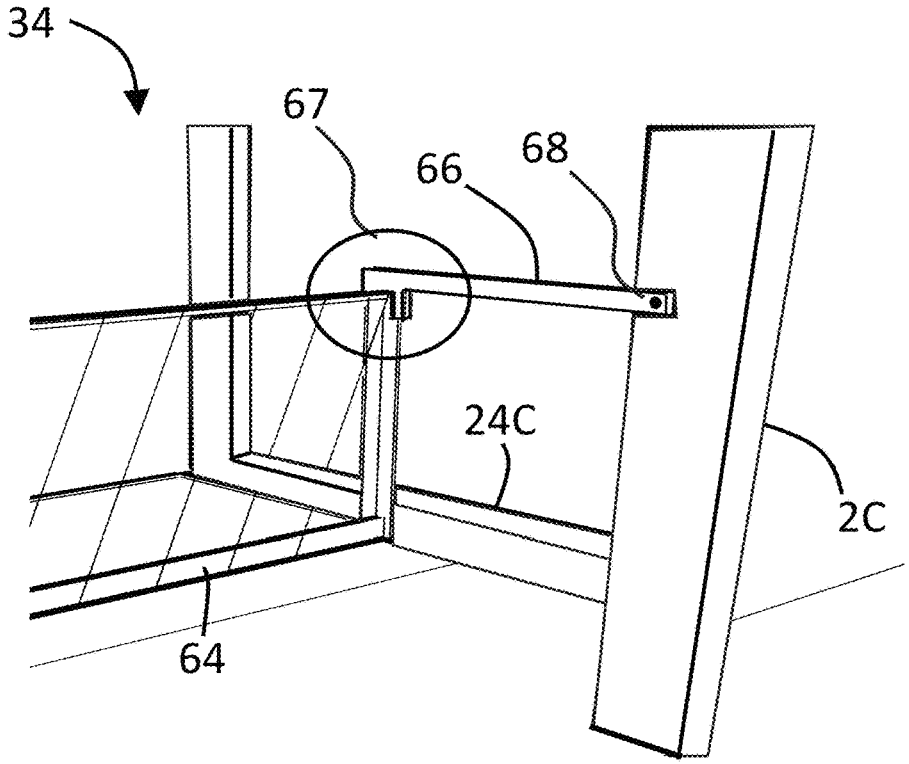
FIG. 20 shows a schematic, perspective, enlarged view of an example of an open, tubular cabinet structure with wheelchair access in the middle cabinet, showing a metal mesh shelf in the locked, up position, according to the present disclosure.

FIG. 20 shows a schematic, perspective, enlarged view of an example of an open, tubular cabinet structure 34 with wheelchair access 62 in the middle cabinet B, showing a metal mesh shelf 64 in the locked, up position, according to the present disclosure. Locking bar 66, with hinge 68 and "F"-shaped locking end 67 is in the locked position, holding shelf 64 in the upright position.

Figure 21:
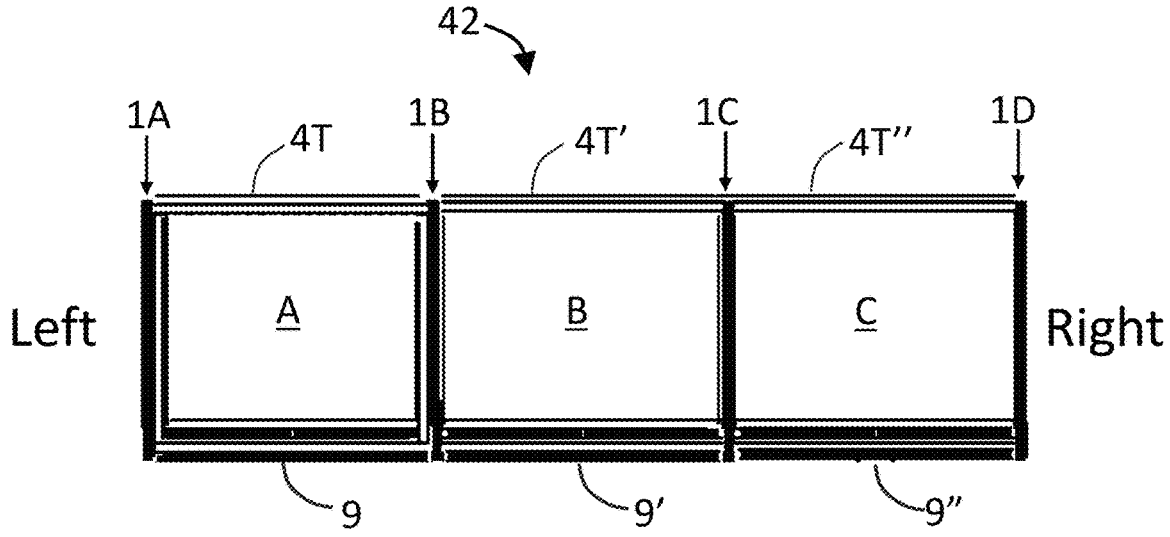
FIG. 21 shows a schematic, top view of an example of three adjacent, open, tubular cabinet structures with hinged front doors and false fronts, according to the present disclosure.

FIG. 21 shows a schematic, top view of an example of three adjacent, open, tubular cabinet structures 42 (A, B, C) with hinged front doors 8, 8' and false fronts 9, according to the present disclosure. Subframes 1A, 1B, 1C, and 1D are shown, along with horizontal top frames 4T, 4T', and 4T".

Figure 22:
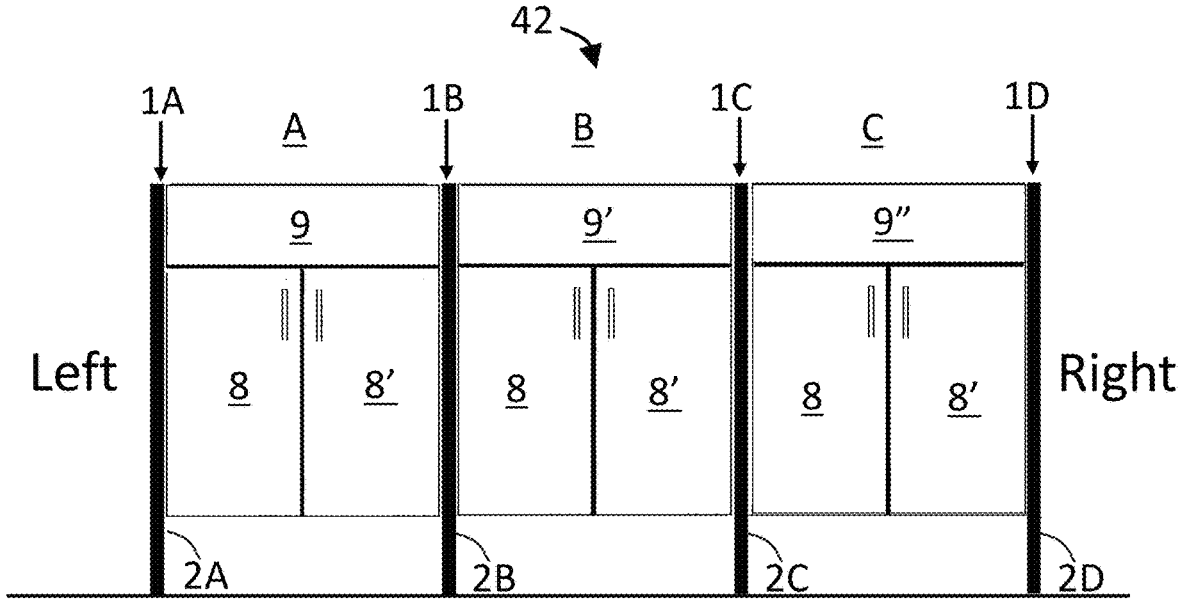
FIG. 22 shows a schematic, front view of an example of three adjacent, open, tubular cabinet structures with hinged front doors and false fronts, according to the present disclosure.

FIG. 22 shows a schematic, front view of an example of three adjacent, open, tubular cabinet structures 42 (A, B, C) with hinged front doors 8, 8' and false fronts 9, according to the present disclosure. Subframes 1A, 1B, 1C, and 1D are shown, along with backward-angled front legs 2A, 2B, 2C, and 2D.

Figure 23:
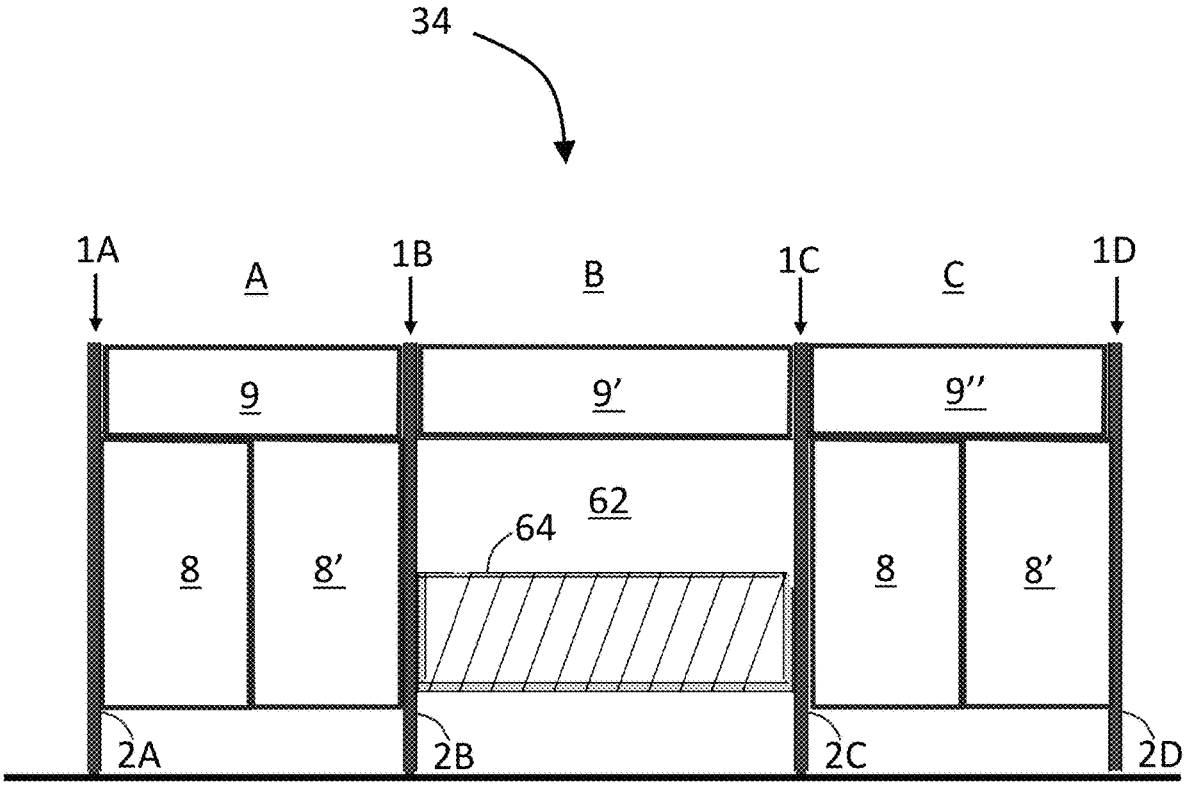
FIG. 23 shows a schematic, front view of an example of three adjacent, open, tubular cabinet structures with hinged front doors and false fronts, with wheelchair access in the middle cabinet, according to the present disclosure.

FIG. 23 shows a schematic, front view of an example of three adjacent, open, tubular cabinet structures 34 (A, B, and C) with hinged front doors 8, 8' and false fronts 9, with wheelchair access 62 in the middle cabinet B, according to the present disclosure. A raised metal mesh shelf 64 is located in middle cabinet B. Backward-angled front legs 2A, 2B, 2C, and 2D are identified.

Figure 24:
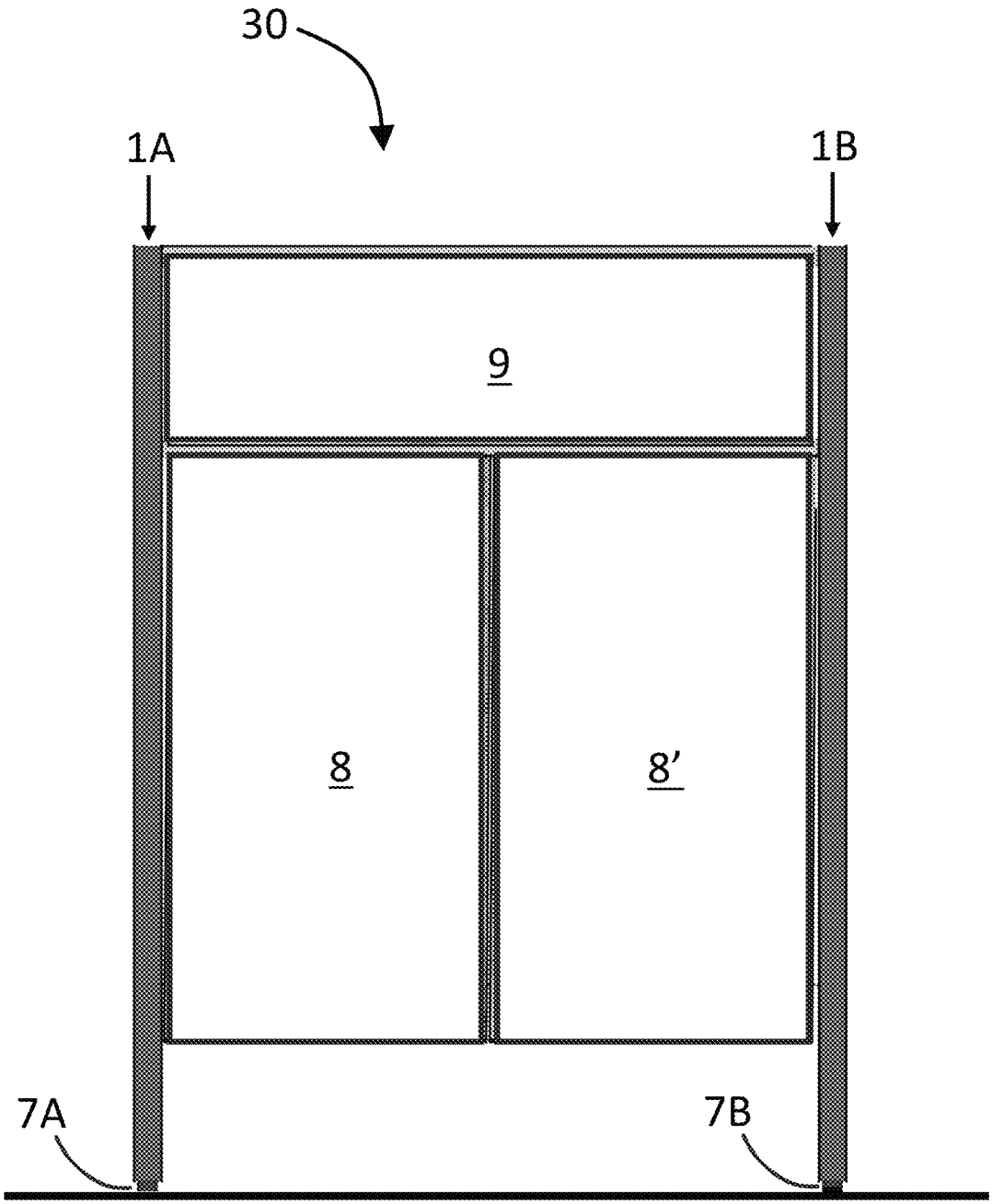
FIG. 24 shows a schematic, front view of an example of an open, tubular cabinet structure with hinged front doors and a false front, and angled front legs, according to the present disclosure.

FIG. 24 shows a schematic, front view of an example of an open, tubular cabinet structure 30 with hinged front doors 8, 8' and a false front 9, and backward-angled front legs 2A and 2B, according to the present disclosure. Front, adjustable leveling feet 7A and 7B are shown.

Figure 25:
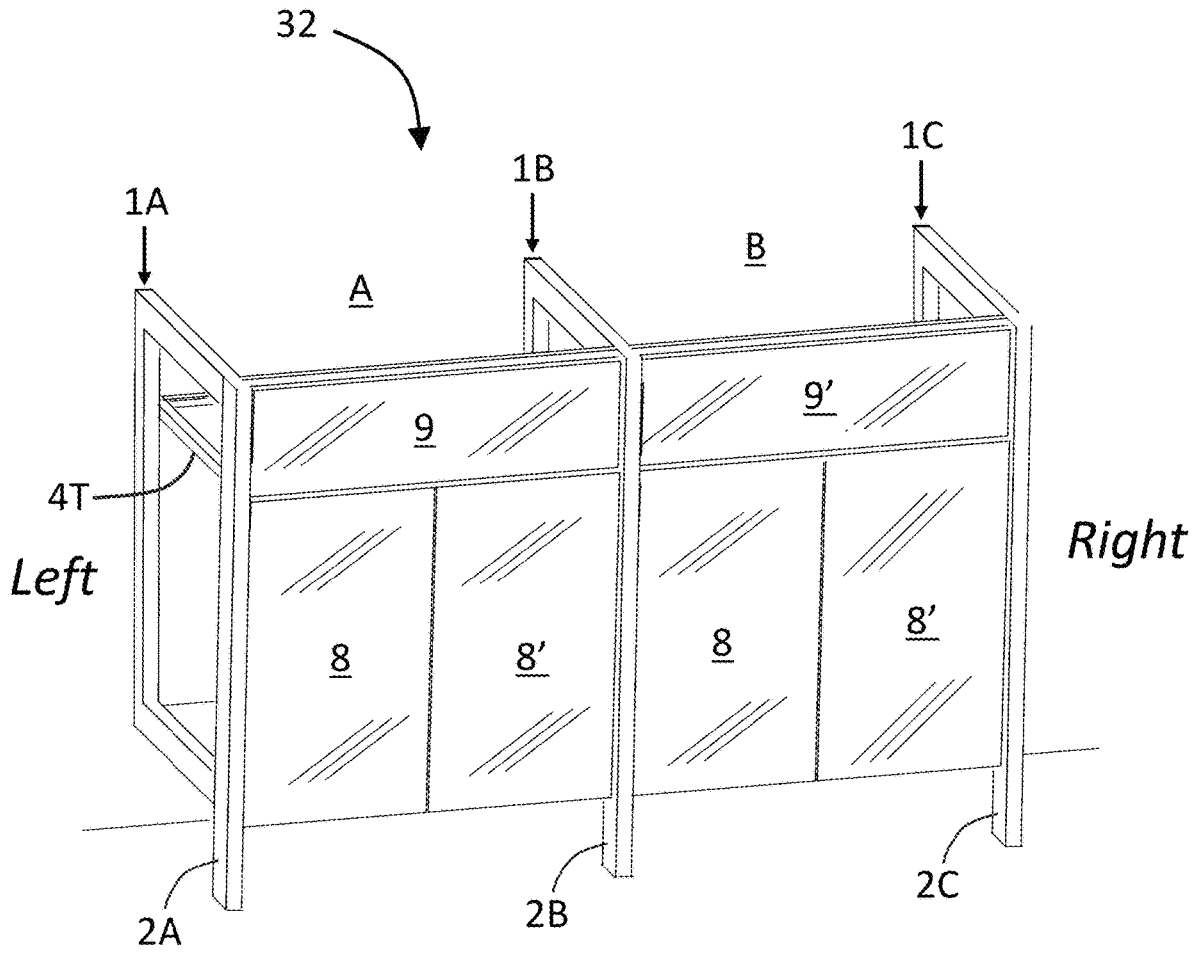
FIG. 25 shows a schematic, perspective view of an example of two adjacent, open, tubular cabinet structures with hinged front doors and false fronts, according to the present disclosure.

FIG. 25 shows a schematic, perspective view of an example of two adjacent, open, tubular cabinet structures 32 with hinged front doors 8, 8' and false fronts 9, 9' according to the present disclosure. Cabinets A and B share a common subframe 1B. The ends, back sides, bottoms, and tops of cabinets A and B are open. Only the front side is covered with hinged front doors 8, 8' and false fronts 9, 9'.

Figure 26:
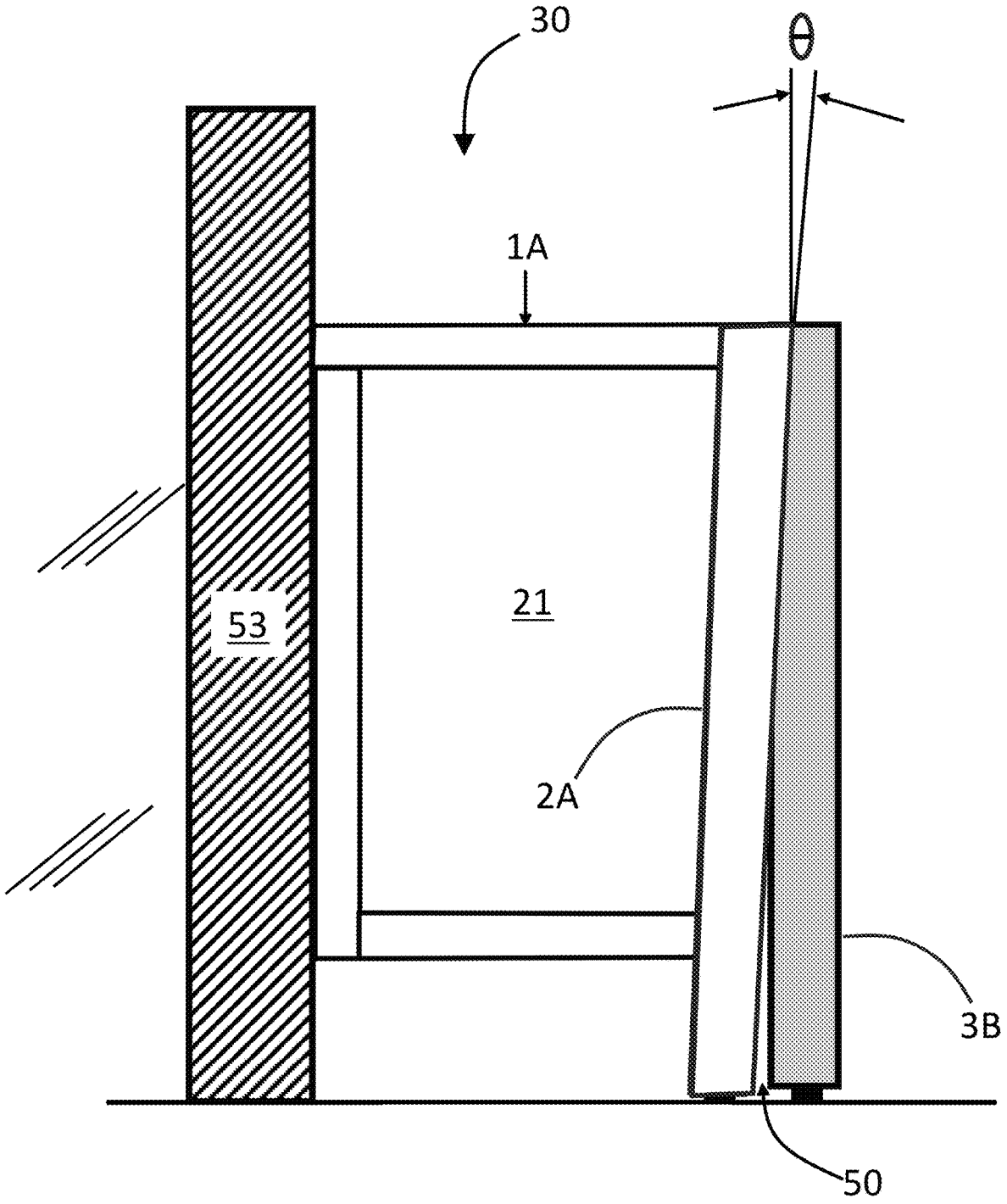
FIG. 26 shows a schematic, side view of an example of an open, tubular cabinet structure with a backward-angled left front leg and a straight right front leg, illustrating a gap between the two front legs near the floor, according to the present disclosure.

FIG. 26 shows a schematic, side view of an example of an open, tubular cabinet structure 30 with a backward-angled left front leg 2A and a straight right front leg 3B, illustrating a gap 50 between the two front legs 2A and 3B near the floor (as viewed from the side), according to the present disclosure. Cabinet 30 comprises subframe 1A, which is attached to wall 53. Subframe 1A has an opening 21 in the middle of subframe 1A. Angle, θ, of backward-angled front leg 2A can be appropriately chosen to make gap 50 disappear.

Figure 27:
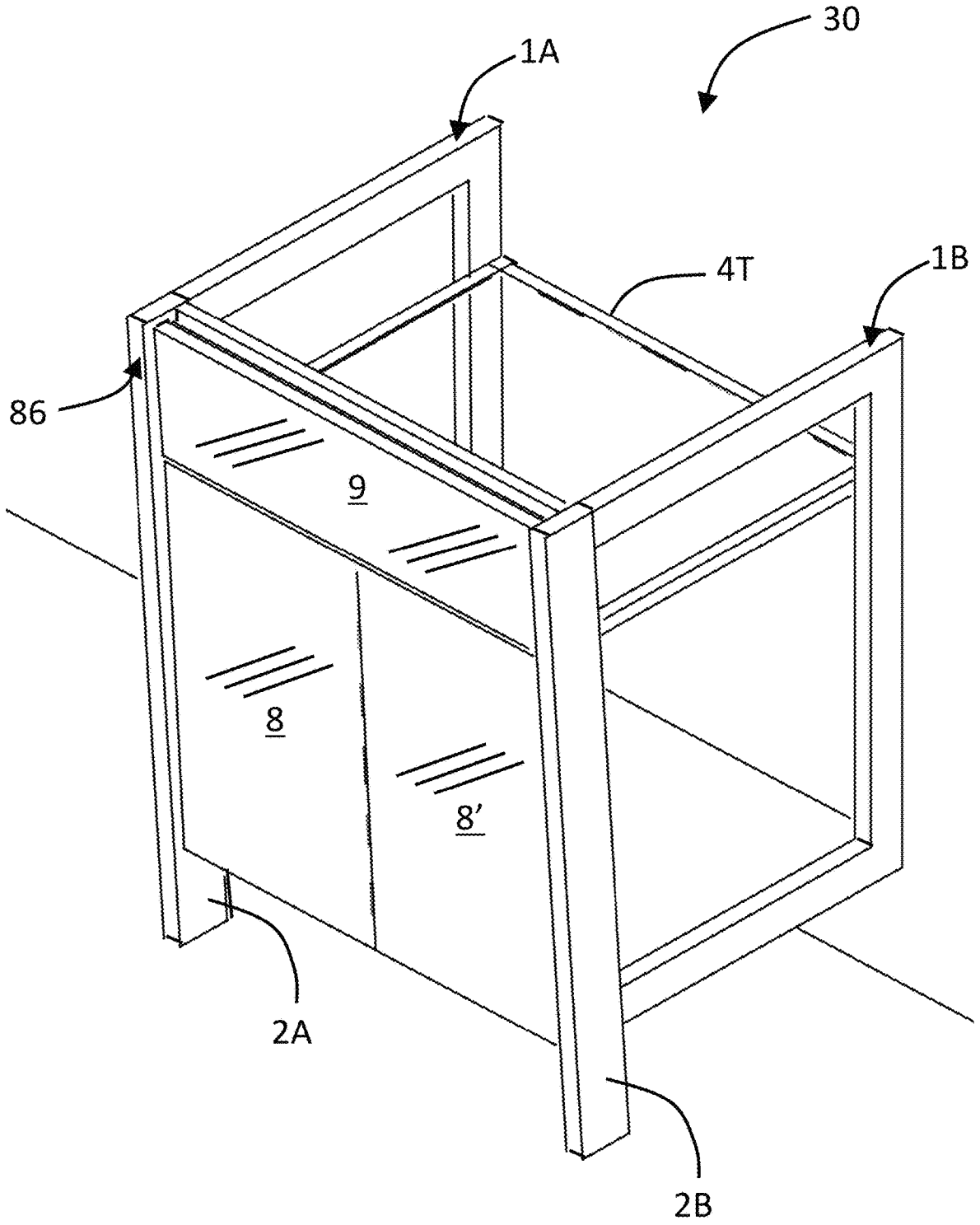
FIG. 27 shows a schematic, perspective view of an example of an open, tubular cabinet structure with angled front legs, according to the present disclosure.

FIG. 27 shows a schematic, perspective view of an example of an open, tubular cabinet structure 30 with backward-angled front legs 2A and 2B, according to the present disclosure. Subframes 1A and 1B are shown, along with horizontal top frame 4T. False front 9 and hinged door panels 8 and 8' are recessed back from the front edge of front legs 2A and 2B by about ½"(note: this applies regardless of if the front legs are backward-angled or straight). False front 9 and hinged door panels 8 and 8' are backward-angled at the same angle, θ, as the backward-angled front legs 2A and 2D (i.e., a constant recess distance down the length of backward-angled front legs 2A and 2B).

Figure 28:
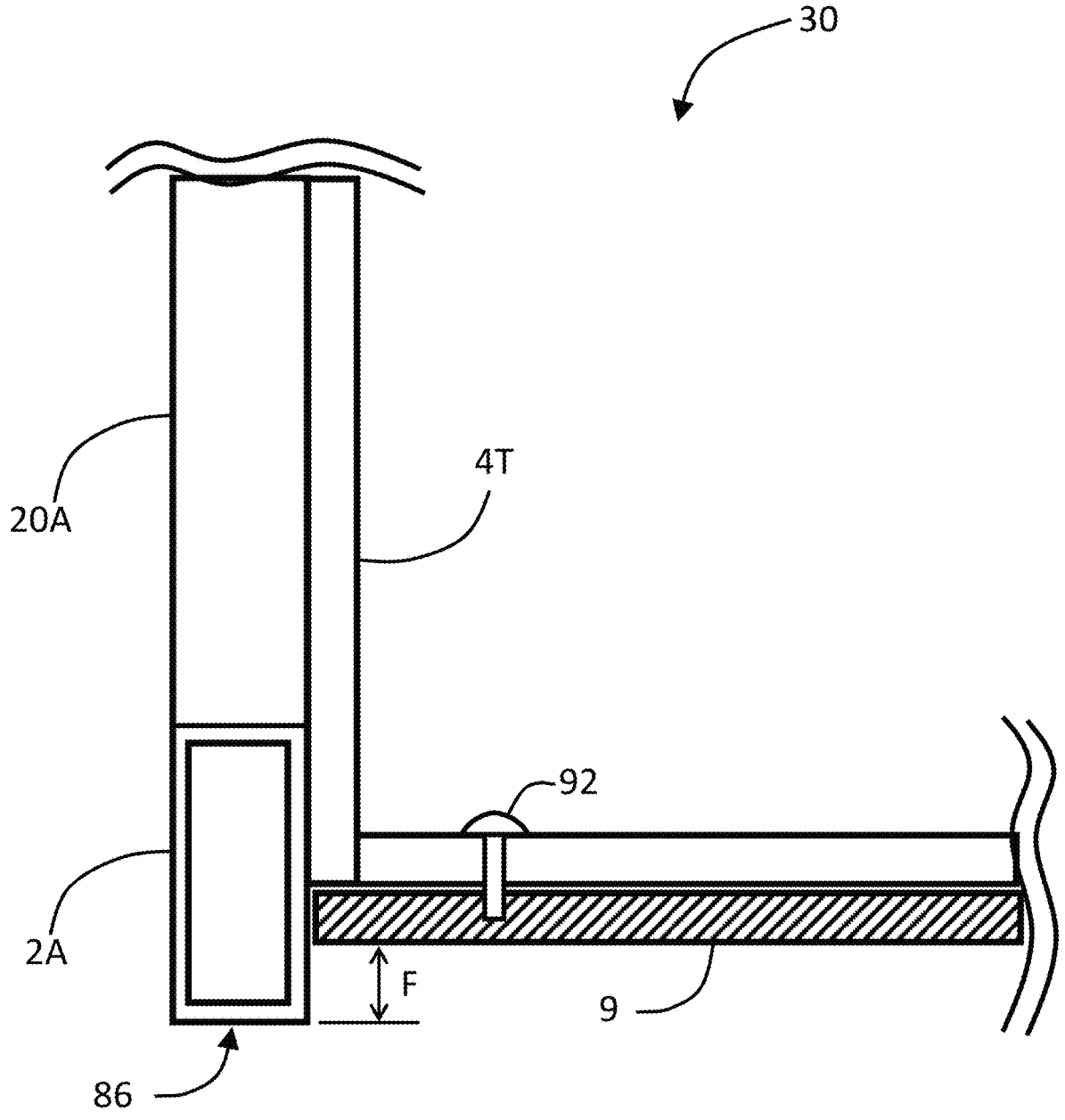
FIG. 28 shows a schematic, top view of an example of an enlarged left corner of an open, tubular cabinet structure with angled front leg and a recessed false front panel, according to the present disclosure.

FIG. 28 shows a schematic, enlarged top view of an example of a left corner of an open, tubular cabinet structure 30 with angled front leg 2A and a recessed false front panel 9, according to the present disclosure. False front panel 9 is recessed backwards by a distance=F from the front edge 86 of front leg 2A. The recess distance, F, can range from 0 to 1", with a preferred distance=¼". False front panel 9 can be removably attached to top horizontal support frame 4T or top horizontal support bar 6 (not shown) with screw 92.

Figure 29:
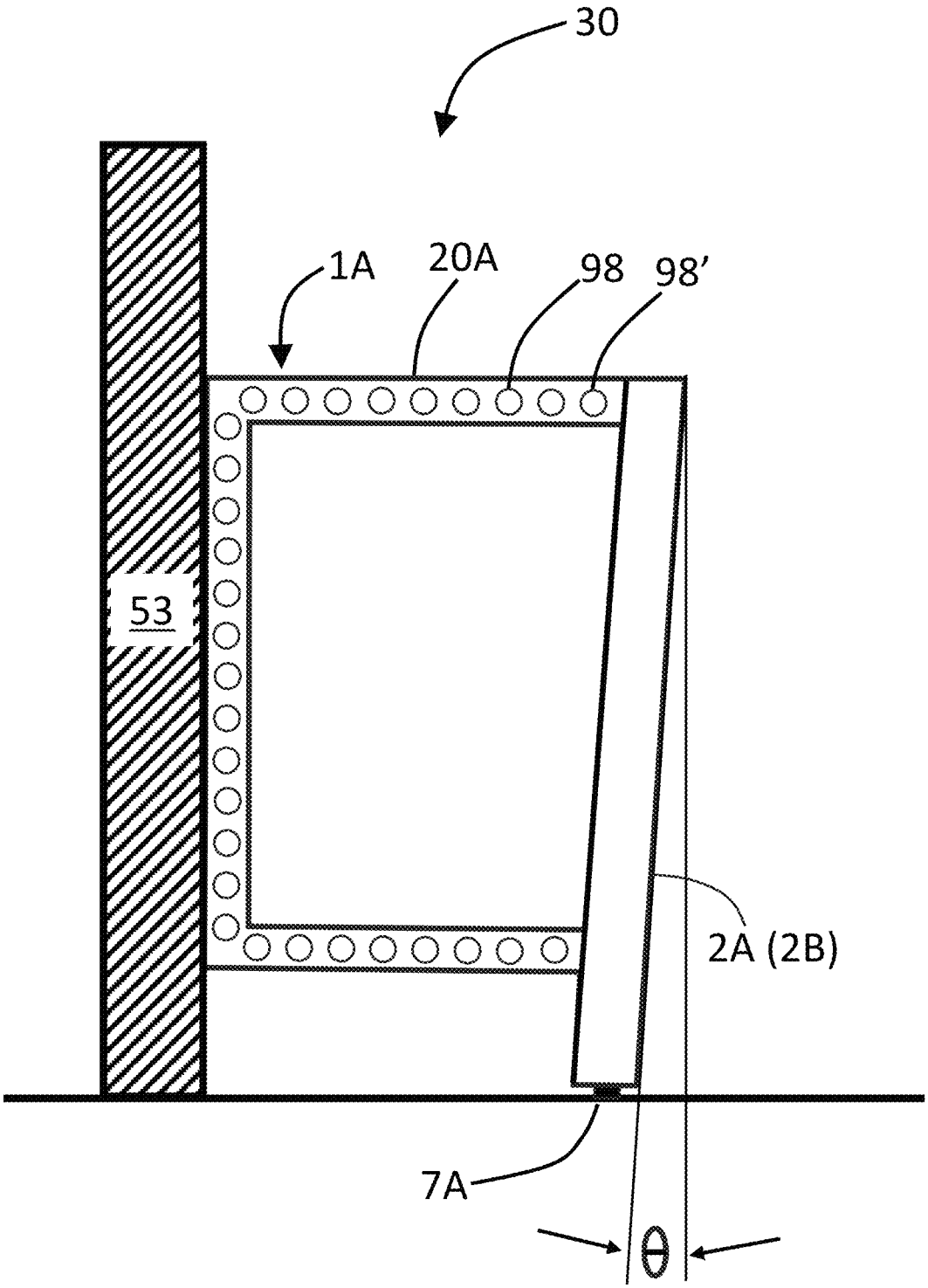
FIG. 29 shows a schematic, side view of an example of a first subframe of a cabinet, with a plurality of weight-reducing holes drilled through three of the four tubular channels.

FIG. 29 shows a schematic, side view of an example of a first subframe 1A of cabinet 30 with a plurality of weight-reducing holes 98, 98', etc. drilled through three of the four linear segments: 20A, 22A, and 24A.

In another embodiment, false front 9 and hinged door panels 8 and 8' can all be oriented vertically, independent of the backward angle, θ, of front legs 2A and 2B.

In some embodiments, the linear structural segments disclosed above (and shown in the drawings) can be a 3-D printed metal, polymer, or fiber-reinforced polymer monolithic structure. Alternatively, the structural channels can be cast, injection molded, or extruded metal, polymer, or fiber-reinforced polymer material, or combinations thereof.

I claim:

1. A cabinet subframe, comprising:

a set of four, linear segments that are joined together to make a four-sided, planar, cabinet subframe defining a central opening;

wherein the four linear segments comprise:

(a) an angled front leg, (b) a vertical rear post, (c) a horizontal top brace, and (d) a horizontal bottom brace;

wherein the angled front leg is attached to the horizontal top brace and the horizontal bottom brace;

wherein the vertical rear post is attached to the horizontal top brace and the horizontal bottom brace;

wherein the horizontal top brace is attached to the angled front leg and the vertical rear post; and wherein the horizontal bottom brace is attached to the angled front leg and the vertical rear post;

wherein the angled front leg extends continuously below the horizontal bottom brace and downwards to a floor;

wherein the vertical rear post does not extend below the horizontal bottom brace;

wherein the angled front leg is angled backwards towards the vertical rear post at a backward angle, θ, with respect to a vertical plumb line; and wherein θ ranges from 3 to about 10 degrees.

2. The cabinet subframe of claim 1, wherein the set of four, linear segments comprise metallic, structural channels that are welded, riveted, brazed, or mechanically fastened together.

3. The cabinet subframe of claim 1, wherein each linear segment comprises a hollow, rectangular, metallic, tubular, structural channel.

4. The cabinet subframe of claim 1, wherein the backward angle, θ, is about 4 degrees.

5. The cabinet subframe of claim 1, wherein the angled front leg extends downwards below the horizontal bottom brace to a floor.

6. A dual-frame cabinet, comprising:

a first cabinet subframe, comprising a first set of four linear segments that are joined together to make a planar, four-sided, first cabinet subframe defining a first central opening;

wherein the first set of four linear segments comprise:

(a) a first angled front leg, (b) a first vertical rear post, (c) a first horizontal top brace, and (d) a first horizontal bottom brace;

wherein the first angled front leg is attached to the first horizontal top brace and the first horizontal bottom brace;

wherein the first vertical rear post is attached to the first horizontal top brace and the first horizontal bottom brace;

wherein the first horizontal top brace is attached to the first angled front leg and the first vertical rear post;

wherein the first horizontal bottom brace is attached to the first angled front leg and the first vertical rear post;

wherein the dual-frame cabinet further comprises:

a second cabinet subframe, comprising a second set of four linear segments that are joined together to make a planar, four-sided, second cabinet subframe defining a second central opening;

wherein the second set of four linear segments comprise:

(e) a second angled front leg, (f) a second vertical rear post, (q) a second horizontal top brace, and (h) a second horizontal bottom brace;

wherein the second angled front leg is attached to the second horizontal top brace and the second horizontal bottom brace;

wherein the second vertical rear post is attached to the second horizontal top brace and the second horizontal bottom brace;

wherein the second horizontal top brace is attached to the second angled front leg and the second vertical rear post;

wherein the second horizontal bottom brace is attached to the second angled front leg and the second vertical rear post;

wherein the dual-frame cabinet further comprises:

a top horizontal support frame that is attached to an upper part of both the first cabinet subframe and the second cabinet subframe; and a bottom horizontal support frame that is attached to a lower part of both the first cabinet subframe and the second cabinet subframe;

wherein the first angled front leg extends continuously below the first horizontal bottom brace and downwards to a floor;

wherein the second angled front leg extends continuously below the second horizontal bottom brace and downwards to the floor;

wherein the first vertical rear post does not extend below the first horizontal bottom brace;

wherein the second vertical rear post does not extend below the second horizontal bottom brace;

wherein the first angled front leg is angled backwards towards the first vertical rear post at a backward angle, θ;

wherein the second angled front leg is angled backwards towards the second vertical rear post at the backward angle, θ; and wherein θ ranges from 3 to about 10 degrees.

7. The dual-frame cabinet of claim 6, wherein the first set of four linear segments and the second set of four linear segments each comprise hollow, rectangular, metallic, tubular, structural channels that are welded, riveted, brazed, or mechanically fastened together.

8. The dual-frame cabinet of claim 6, further comprising a top, horizontal support bar that spans horizontally across the first cabinet subframe to the second cabinet subframe; and wherein the top, horizontal support bar is positioned near a front edge of the dual-frame cabinet.

9. The dual-frame cabinet of claim 6, wherein the dual-frame cabinet is configured to be attached to a wall with one or more screws that pass through the top horizontal support frame and/or through the bottom horizontal support frame.

10. The dual-frame cabinet of claim 6, further comprising a face panel attached to the top horizontal support frame and/or attached to the bottom horizontal support frame, wherein the face panel is recessed behind a front edge of both the first cabinet subframe and the second cabinet subframe.

11. The dual-frame cabinet of claim 6, wherein the dual-frame cabinet does not comprise any side finish panels or rear finish panels.

12. The dual-frame cabinet of claim 6, wherein the backward angle, θ, is about 4 degrees.

13. The dual-frame cabinet of claim 6, further comprising:

an open space disposed underneath the first second horizontal bottom brace, the second horizontal bottom brace, and the bottom horizontal support frame;

wherein the open space is accessible from a front side of the dual-frame cabinet; and wherein the open space is sufficiently tall so that a robotic vacuum cleaner machine can fit completely inside of the open space without touching the dual-frame cabinet.

14. A dual-frame cabinet, comprising:

a first cabinet subframe, comprising a first set of four linear segments that are joined together to make a planar, four-sided, first cabinet subframe with a first central opening;

a second cabinet subframe, comprising a second set of four linear segments that are joined together to make a planar, four-sided, second cabinet subframe with a second central opening;

a top horizontal support frame that is attached to an upper part of both the first cabinet subframe and the second cabinet subframe; and a bottom horizontal support frame that is attached to a lower part of both the first cabinet subframe and the second cabinet subframe;

wherein the first cabinet subframe comprises a first angled front leg that extends downwards to a floor;

wherein the first cabinet subframe does not have a first vertical back post that extends down to the floor;

wherein the second cabinet subframe comprises a second vertical front leg that extends downwards to the floor;

wherein the second cabinet subframe does not have a second vertical back post that extends down to the floor;

wherein the first angled front leg is angled backwards towards a first vertical rear post at a backward angle, θ, with respect to a vertical plumb line, wherein θ ranges from 3 to about 10 degrees; and wherein the second vertical front leg is oriented vertically (θ=0).

15. A dual cabinet system, comprising a first dual-frame cabinet;

a second dual-frame cabinet;

a first cabinet subframe;

a second cabinet subframe; and a third cabinet subframe;

wherein the first dual-frame cabinet is attached to the first cabinet subframe on a first side and the first dual-frame cabinet is attached to the second cabinet subframe on an opposite, second side;

wherein the second dual-frame cabinet is attached to the second cabinet subframe on a third side and the second dual-frame cabinet is attached to the third cabinet subframe on an opposite, fourth side;

wherein the first subframe comprises:

(a) a first front leg, (b) a first vertical rear post, (c) a first horizontal top brace, and (d) a first horizontal bottom brace;

wherein the first front leg is attached to the first horizontal top brace and the first horizontal bottom brace;

wherein the first vertical rear post is attached to the first horizontal top brace and the first horizontal bottom brace;

wherein the first horizontal top brace is attached to the first front leg and the first vertical rear post; and wherein the first horizontal bottom brace is attached to the first front leg and the first vertical rear post; and further wherein the second subframe comprises:

(e) a second front leg, (f) a second vertical rear post, (q) a second horizontal top brace, and (h) a second horizontal bottom brace;

wherein the second front leg is attached to the second horizontal top brace and the second horizontal bottom brace;

wherein the second vertical rear post is attached to the second horizontal top brace and the second horizontal bottom brace;

wherein the second horizontal top brace is attached to the second front leg and the second vertical rear post; and wherein the second horizontal bottom brace is attached to the second front leg and the second vertical rear post; and further wherein the third subframe comprises:

(e) a third front leg, (f) a third vertical rear post, (q) a third horizontal top brace, and (h) a third horizontal bottom brace;

wherein the third front leg is attached to the third horizontal top brace and the third horizontal bottom brace;

wherein the third vertical rear post is attached to the third horizontal top brace and the third horizontal bottom brace;

wherein the third horizontal top brace is attached to the third front leg and the third vertical rear post;

wherein the third horizontal bottom brace is attached to the third front leg and the third vertical rear post;

wherein the first front leg extends continuously below the first horizontal bottom brace and downwards to a floor;

wherein the second front leg extends continuously below the second horizontal bottom brace and downwards to the floor;

wherein the third front leg extends continuously below the third horizontal bottom brace and downwards to the floor;

wherein the first vertical rear post does not extend below the first horizontal bottom brace;

wherein the second vertical rear post does not extend below the second horizontal bottom brace;

wherein the third vertical rear post does not extend below the third horizontal bottom brace;

wherein the first dual-frame cabinet and the second dual-frame cabinet are both attached to the second cabinet subframe;

wherein at least one front leg is angled backwards towards a vertical rear post at a backward angle, θ; and wherein θ ranges from 3 to about 10 degrees.

16. The dual cabinet system of claim 15, wherein the backward angle, θ, is about 4 degrees.

17. The dual cabinet system of claim 15, wherein each set of four, linear segments comprise metallic, structural channels that are welded, riveted, brazed, or mechanically fastened together.

18. The dual cabinet system of claim 15, wherein each linear segment comprises a hollow, rectangular, metallic, tubular, structural channel.

19. The dual cabinet system of claim 15, wherein the first dual-frame cabinet further comprises a first top horizontal support bar that spans horizontally across the first cabinet subframe to the second cabinet subframe; and wherein the first top horizontal support bar is positioned near a front edge of the first dual-frame cabinet;

wherein the second dual-frame cabinet further comprises a second top horizontal support bar that spans horizontally across the second cabinet subframe to the third cabinet subframe; and wherein the second top horizontal support bar is positioned near a front edge of the second dual-frame cabinet.

20. The dual cabinet system of claim 15, wherein the first dual-frame cabinet further comprises:

a first top horizontal support frame that is attached to an upper part of both the first cabinet subframe and the second cabinet subframe; and a first bottom horizontal support frame that is attached to a lower part of both the first cabinet subframe and the second cabinet subframe; and wherein the second dual-frame cabinet further comprises:

a second top horizontal support frame that is attached to an upper part of both the second cabinet subframe and the third cabinet subframe; and a second bottom horizontal support frame that is attached to a lower part of both the second cabinet subframe and the third cabinet subframe; and wherein the dual cabinet system is configured to be attached to a wall with one or more screws that pass through the first top horizontal support frame and/or through the first bottom horizontal support frame and through the second top horizontal support frame and/or through the second bottom horizontal support frame.

* * * * *